US009770635B2

(12) United States Patent
Motokawa et al.

(10) Patent No.: US 9,770,635 B2
(45) Date of Patent: Sep. 26, 2017

(54) GOLF CLUB HEAD

(71) Applicant: DUNLOP SPORTS CO. LTD., Kobe-shi, Hyogo (JP)

(72) Inventors: Yuki Motokawa, Kobe (JP); Kota Yamasawa, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/053,759

(22) Filed: Feb. 25, 2016

(65) Prior Publication Data

US 2016/0250525 A1 Sep. 1, 2016

(30) Foreign Application Priority Data

Feb. 26, 2015 (JP) ..... 2015-036787

(51) Int. Cl.

| | |
|---|---|
| ***A63B 53/04*** | (2015.01) |
| ***A63B 60/02*** | (2015.01) |
| ***A63B 60/04*** | (2015.01) |
| *A63B 60/52* | (2015.01) |

(52) U.S. Cl.

CPC ..... *A63B 53/0466* (2013.01); *A63B 60/02* (2015.10); *A63B 60/04* (2015.10); *A63B 53/04* (2013.01); *A63B 60/52* (2015.10); *A63B 2053/0408* (2013.01); *A63B 2053/0433* (2013.01); *A63B 2053/0491* (2013.01)

(58) Field of Classification Search

CPC ..... A63B 2053/0491; A63B 53/04; A63B 2053/0433

USPC ..... 473/334–339, 341, 345

See application file for complete search history.

(56) References Cited

U.S. PATENT DOCUMENTS

| | | | | |
|---|---|---|---|---|
| 5,913,735 | A * | 6/1999 | Kenmi | A63B 53/04 29/447 |
| 6,306,048 | B1 * | 10/2001 | McCabe | A63B 53/04 473/333 |
| 8,328,661 | B1 | 12/2012 | Erickson | |
| 8,900,070 | B1 * | 12/2014 | Dawson | A63B 53/047 473/329 |
| 2008/0153624 | A1 | 6/2008 | Ban et al. | |
| 2008/0227565 | A1 | 9/2008 | Ban et al. | |
| 2009/0143167 | A1 * | 6/2009 | Evans | A63B 53/0466 473/335 |

(Continued)

FOREIGN PATENT DOCUMENTS

| | | | |
|---|---|---|---|
| JP | 06-296716 | A | 10/1994 |
| JP | 07-265473 | A | 10/1995 |
| JP | 11-137739 | A | 5/1999 |

(Continued)

*Primary Examiner* — Benjamin Layno

(74) *Attorney, Agent, or Firm* — Birch, Stewart, Kolasch & Birch, LLP

(57) ABSTRACT

A golf club head is composed of a head main body comprising a face portion, a crown portion and a sole portion, and having a hollow, and a weight member disposed in the hollow of the head main body. The weight member is fixed to a toe side of the head main body at a toe side end portion and fixed to a heel side of the head main body at a heel side end portion so as not to contact with the inner surface of the head main body between the toe side end portion and heel side end portion. The cross-sectional area of the weight member is decreased in a central portion in the toe-heel direction than its heel side and toe side.

8 Claims, 25 Drawing Sheets

(56) References Cited

U.S. PATENT DOCUMENTS

| | | | | |
|---|---|---|---|---|
| 2009/0280924 | A1* | 11/2009 | Harvell | A63B 53/0466<br>473/335 |
| 2015/0065265 | A1* | 3/2015 | Motokawa | A63B 53/06<br>473/335 |

FOREIGN PATENT DOCUMENTS

| | | | |
|---|---|---|---|
| JP | 2000-157653 | A | 6/2000 |
| JP | 2001-204856 | A | 7/2001 |
| JP | 2004-121362 | A | 4/2004 |
| JP | 2006-320493 | A | 11/2006 |
| JP | 2008-154674 | A | 7/2008 |
| JP | 2008-220731 | A | 9/2008 |
| JP | 2008-246083 | A | 10/2008 |
| JP | 2009-072535 | A | 4/2009 |
| JP | 2009-240653 | A | 10/2009 |

* cited by examiner

GOLF CLUB HEAD

BACKGROUND OF THE INVENTION

The present invention relates to a golf club head comprising a head main body and a weight member, more particularly to a golf club head having a large moment of inertia.

U.S. Pat. No. 8,328,661 discloses a hollow golf club head comprising a cup-shaped face member, and a head main body joined thereto in order to provide a shallow and low center of gravity for the head. A tongue-shaped weight member extending in the toe-heel direction is fixed to a sole portion of the head main body. The weight member extends toward the front so as to be positioned in a cavity of the face member.

SUMMARY OF THE INVENTION

In the above-mentioned head, since the weight member is fixed to the inner surface of the sole portion, the sole portion has a high flexural rigidity. Therefore, the head main body of the above-mentioned head is hard to deflect at the time of striking a ball, and there is a possibility that the rebound performance is deteriorated. Further, there is a problem such that the moment of inertia about a vertical axis passing through the center of gravity of the head (hereinafter, simply referred to the "moment of inertia") is small.

In view of the above problems, the present invention was made, and a primarily object the present invention is to provide a golf club head having a large moment of inertia.

According to a first aspect of the present invention, a golf club head comprises a head main body comprising a face portion, a crown portion and a sole portion, and having a hollow therein, and a weight member disposed within the hollow, wherein the weight member extends continuously between its toe side end portion fixed to a toe side part of the head main body, and its heel side end portion fixed to a heel side part of the head main body, in a vertical plane including the center of gravity of the head and a sweet spot of a club face of the face portion, the weight member does not contact with the inner surface of the head main body, and a cross-sectional area of the weight member measured in parallel with the above-mentioned vertical plane is smaller in its central portion in the toe-heel direction than in a heel side portion and a toe side portion of the weight member.

In the first aspect of the present invention, it is preferable that the above-mentioned central portion of the weight member includes the above-mentioned vertical plane.

In the first aspect of the present invention, it is preferable that the center of gravity of the weight member is located on the face portion side of the center of gravity of the head.

In the first aspect of the present invention, it is preferable that the center of gravity of the weight member is located on the sole portion side of the center of gravity of the head.

In the first aspect of the present invention, it is preferable that the weight member is provided with a concave portion recessed toward the face portion.

In the first aspect of the present invention, it is preferable that the above-mentioned concave portion of the weight member has a substantially triangular shape in a plan view of the weight member.

In the first aspect of the present invention, it is preferable that the above-mentioned concave portion of the weight member has a circular arc shape in the plan view of the weight member.

In the first aspect of the present invention, it is preferable that the above-mentioned concave portion of the weight member is formed as a curved shape along a circular arc whose center is located within 3 mm from the center of gravity of the head in the plan view.

According to a second aspect of the present application, a golf club head comprises a head main body having a hollow therein, and weight members disposed within the hollow, wherein the weight members include a toe-side weight member and a heel-side weight member, the toe-side weight member has a toe-side end portion fixed to a toe side part of the head main body and extends from the toe-side end portion toward a heel side of the head main body without contacting with the inner surface of the head main body so as to have a heel-side end terminated within the hollow, the heel-side weight member has a heel-side end portion fixed to a heel side part of the head main body and extends from the heel-side end portion toward a toe side of the head main body without contacting with the inner surface of the head main body so as to have a toe-side end terminated within the hollow, and the heel-side end and the toe-side end are spaced apart from each other.

In the second aspect of the present invention, it is preferable that, between the heel-side end and the toe-side end, a space is formed in the toe-heel direction of the head, and the space is increased toward the backward of the head in its plan view.

In the second aspect of the present invention, it is preferable that, in the plan view, the heel-side end and the toe-side end are curved along a circle arc whose center is located within 3 mm from the center of gravity of the head.

In the second aspect of the present invention, it is preferable that a depth of the center of gravity of the head from the club face is not less than a progression of the club face and not more than 27.0 mm, and a moment of inertia of the head around a vertical axis passing through the center of gravity of the head is not less than 2700 g sq. cm.

In the second aspect of the present invention, it is preferable that a percentage depth of the center of gravity is in a range of from {100×face progression (mm)/maximum dimension (mm) of the head in the front-back direction} % to 33.0%, wherein the percentage depth of the center of gravity is 100×the depth of the center of gravity (mm)/the maximum dimension (mm) of the head in the front-back direction.

In the second aspect of the present invention, it is preferable that the moment of inertia of the head around the vertical axis passing through the center of gravity of the head is not less than 2800 g sq. cm.

In the second aspect of the present invention, it is preferable that the head comprises an adjuster for changing the position of the toe-side weight member or the heel-side weight member in at least one of the front-back direction of the head, the up-down direction of the head, and the toe-heel direction of the head.

Therefore, in the golf club head according to the first or second aspect of the present invention, the weight member does not increase the rigidity of the sole portion excessively, and as a result, high rebound performance can be obtained. Further, the weight member can distribute more weight to a toe side and a heel side of the head, therefore, the golf club head is provided with a large moment of inertia, and the directionality of the hit ball is stabilized if missed shot.

In this application, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle while keeping the axis on a vertical plane, and the face forms the specified loft angle with respect to the horizontal plane HP and the specified face angle. Incidentally, in the case of the club head alone, the center line of the shaft inserting hole can be used instead of the axis CL of the club shaft.

The sweet spot SS is a point of intersection between the club face 2*a* and a straight line N drawn from the center CG of gravity of the head perpendicularly to the club face 2*a*.

The front-back direction is a direction parallel with the straight line N projected on the horizontal plane HP.

The toe-heel direction is a direction parallel with the horizontal plane HP and perpendicular to the front-back direction.

DESCRIPTION OF THE PREFERRED EMBODIMENTS

Figure 1:
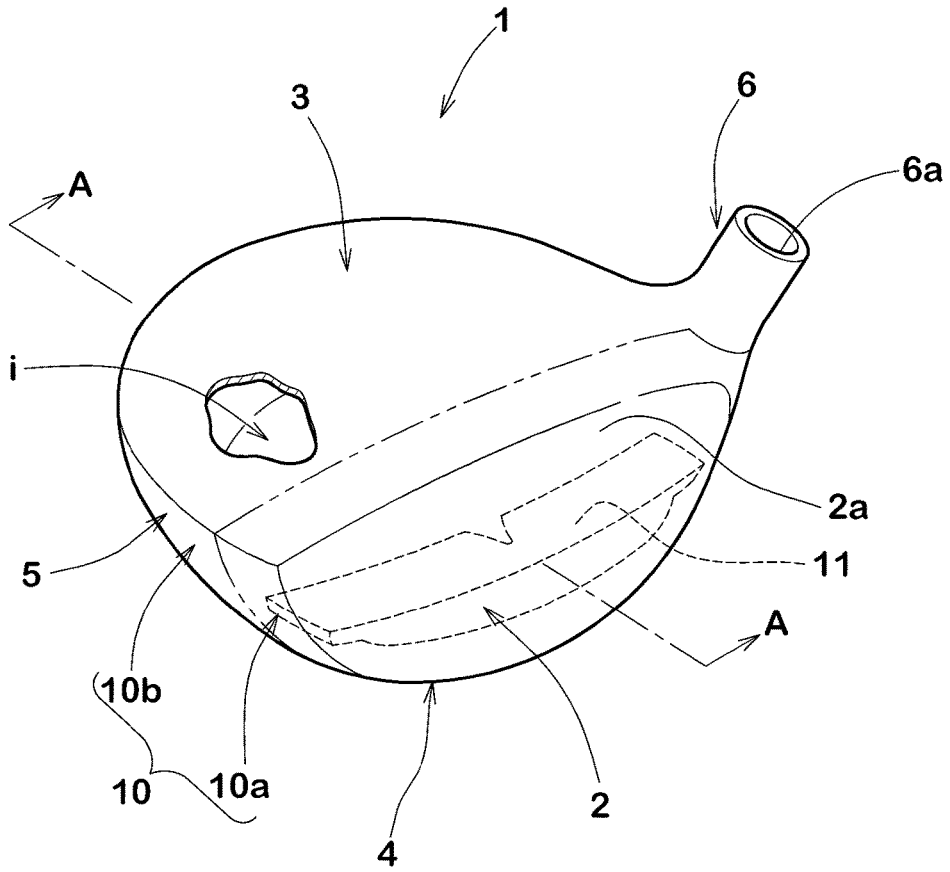
FIG. 1 is a perspective view of a golf club head as an embodiment of the first aspect of the present invention.

Embodiments of the present invention will now be described in detail in conjunction with accompanying drawings, wherein throughout all of the embodiments, the same members are assigned with the same reference numerals.

First Aspect of the Invention

In FIG. 1, there is shown a perspective view of a golf club head 1 as an embodiment of the first aspect of the present invention.

The golf club head 1 comprises a face portion 2, a crown portion 3, a sole portion 4, and a side portion 5 so as to define a hollow i therein.

The face portion 2 has a front surface defining a club face 2*a* for striking a ball.

The crown portion 3 continues from the face portion 2 to define an upper surface of the head.

The crown portion 3 is provided in a heel side thereof with a tubular hosel portion 6 having a shaft inserting hole 6*a* into which a shaft (not shown) is inserted and fixed.

The sole portion 4 continues from the face portion 2 to define a bottom surface of the head.

The side portion 5 extends between the crown portion 3 and the sole portion 4.

The toe-side edge and the heel-side edge of the side portion 5 are connected to the face portion 2.

In this embodiment, the head 1 is for a wood type golf club.

Here, the wood type means at least driver (#1), brassie (#2), spoon (#3), buffy (#4) and cleek (#5). Further, a head having a shape generally similar to those of the heads listed above may be included even if the number or name of the head is different from the numbers or names listed above.

As another embodiment, the head 1 may be formed for a utility type club. Furthermore, the head 1 may be formed for an iron type club as far as the head 1 has a hollow structure.

The head 1 is composed of a head main body 10 and a weight member 11.

The head main body 10 is a shell structure surrounding the hollow i and including all of the face portion 2, the crown portion 3, the sole portion 4, the side portion 5 and the hosel portion 6.

In this embodiment, the head main body 10 is made of a metallic material. As to the metal material, for example, stainless steel, maraging steel, titanium alloy, magnesium alloy and/or aluminum alloy can be used. Further, the head mail body 10 may be made of a fiber reinforced resin.

The volume of the head main body 10 is preferably not more than 470 cc, more preferably not more than 460 cc to satisfy the USGA Golf Rules.

For example, the head main body 10 is made up of a front member 10*a* forming a front side part of the head main body 10 and a rear member 10*b* forming a rear side part of the head main body 10. The "front side" means the club face 2*a* side, and the "rear side" means the opposite side to the club face 2*a*.

The front member 10*a* includes the face portion 2. The front member 10*a* in this embodiment includes the entirety of the face portion 2, and a flange 13 extending backward from a peripheral edge of the face portion 2.

Thus, the front member 10*a* is formed in a shallow cup-like shape having an opening toward the backward and having a rear edge O1 around the opening.

The flange 13 forms a front part of the crown portion 3, a front part of the sole portion 4, a front part of the side portion 5 on the heel side, and a front part of the side portion 5 on the toe side.

Figure 3:
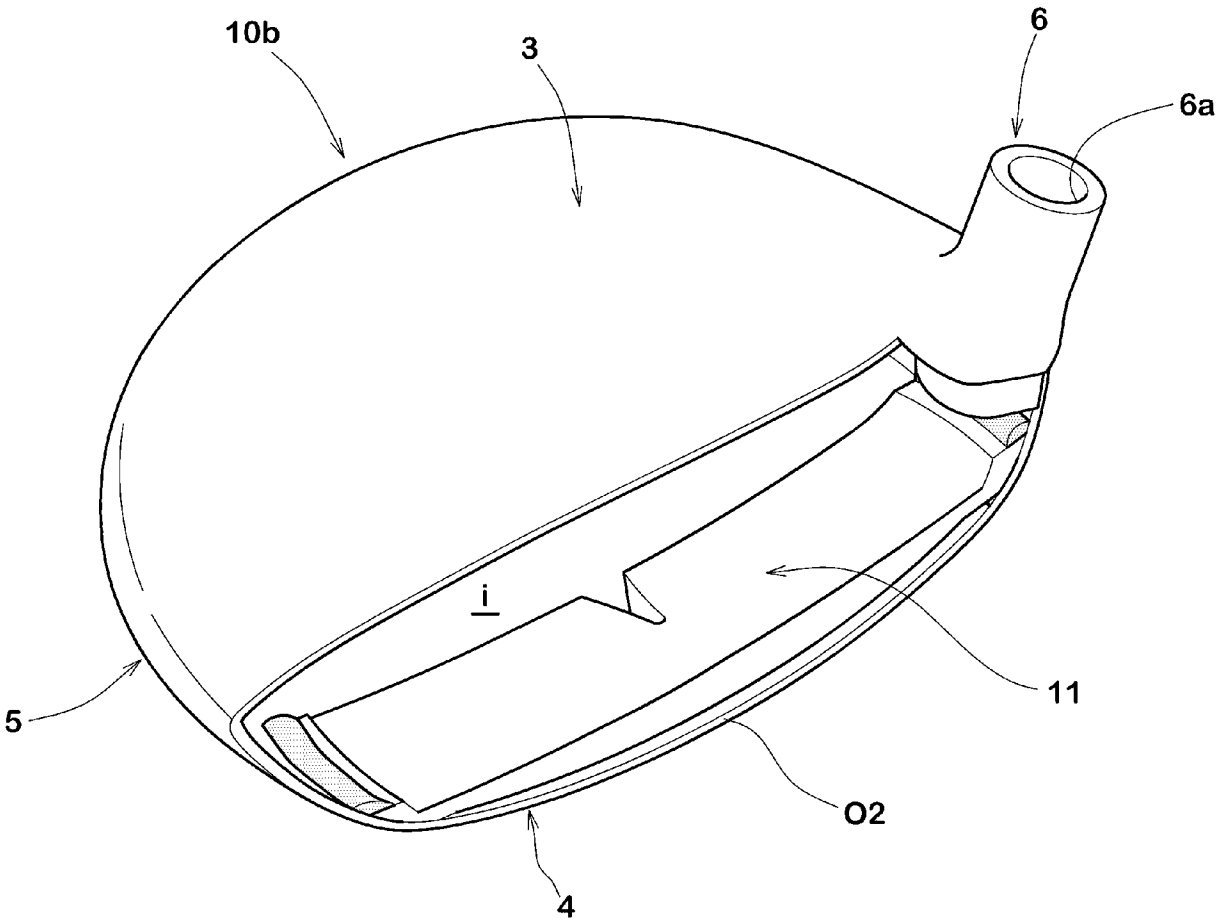
FIG. 3 is a perspective view of a rear side member of the golf club head shown in FIG. 2.

FIG. 3 is a perspective view of the rear member 10*b* of the head main body 10. The rear member 10*b* forms the remaining rear part of the crown portion 3, the remaining rear part of the sole portion 4, and the remaining rear part of the side portions 5. Thus, the rear member 10*b* is formed in a deeper cup-like shape having an opening toward the front and having a front edge O2 around the opening.

In this embodiment, the hosel portion 6 is included in the rear member 10*b*. But, the hosel portion 6 is not limited to such arrangement in particular.

Figure 2:
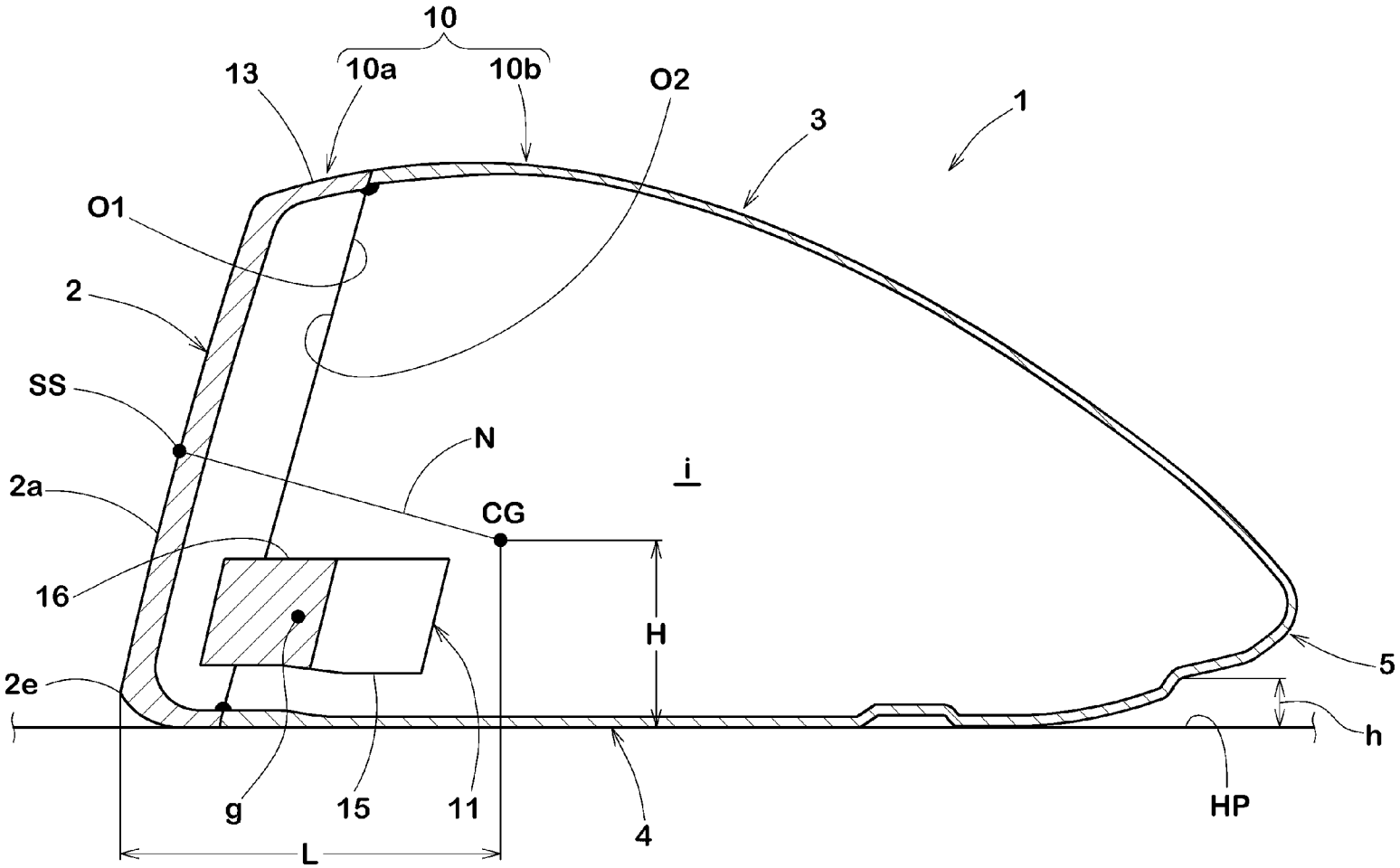
FIG. 2 is a vertical sectional view of the golf club head shown in FIG. 1 taken along a vertical plane including the sweet spot SS and the center of gravity of the head.

The front member 10*a* is fixed to the rear member 10*b*, for example, by welding the rear edge O1 with the front edge O2 as shown in FIG. 2.

The configurations of the front member 10*a* and the rear member 10*b* are not limited to the above.

The weight member 11 is disposed in the hollow i of the head main body 10.

The material of the weight member 11 is not particularly limited, and it can be selected according to the material of the head main body 10. But, the weight member 11 is preferably made of the same material as that of the head main body 10, or a material having a larger specific gravity than that of the head main body 10. For example, a metal material such as stainless steel, titanium alloy, copper alloy tungsten alloy, maraging steel may be preferably used.

If the weight member 11 is made of the same material as that of the head main body 10, it may be possible to form the weight member 11 and the head main body 10 integrally by casting, for example.

The weight member 11 extends in the toe-heel direction as shown in FIG. 3.

As shown in FIG. 2, at least in the vertical plane including the sweet spot SS and the center of gravity of the head 1, the weight member 11 does not contact with the inner surface of the head main body 10 even if the head main body 10 is elastically deformed by striking a ball. For that purpose, the minimum distance between the weight member, 11 and the inner surface is preferably at least 1 mm, more preferably at least 2 mm, still more preferably at least 3 mm.

When hitting a ball with the club face 2*a*, the face portion 2 and the sole portion 4 can deflect without being hindered by the weight member 11. Further, the weight member 11 does not excessively increase the rigidity of the crown portion 3 and the sole portion 4, therefore, the crown portion 3 and the sole portion 4 can deflect flexibly when hitting a ball, and the head 1 can exhibit excellent rebound performance.

It is desirable that, in the vertical plane, as shown in FIG. 2, the weight member 11 is arranged so as to approach to a corner between the face portion 2 and the sole portion 4 or so as to approach to the leading edge 2*e* of the head.

In this embodiment, a front part of the weight member 11 extends forward beyond the rear edge O1 of the front member 10*a* of the head main body 10.

Preferably, the center g of gravity of the weight member 11 is positioned on the sole portion 4 side and on the face portion 2 side of the center CG of gravity of the head 1.

More preferably, the entirety of the weight member 11 is positioned on the sole portion 4 side or on the face portion 2 side of the center CG of gravity of the head 1.

The center CG of gravity of such head 1 becomes low and shallow, therefore, it is possible to hit a golf ball with a trajectory preferred by the experienced golfers, namely, a trajectory achieved by a low spin rate.

Figure 4:
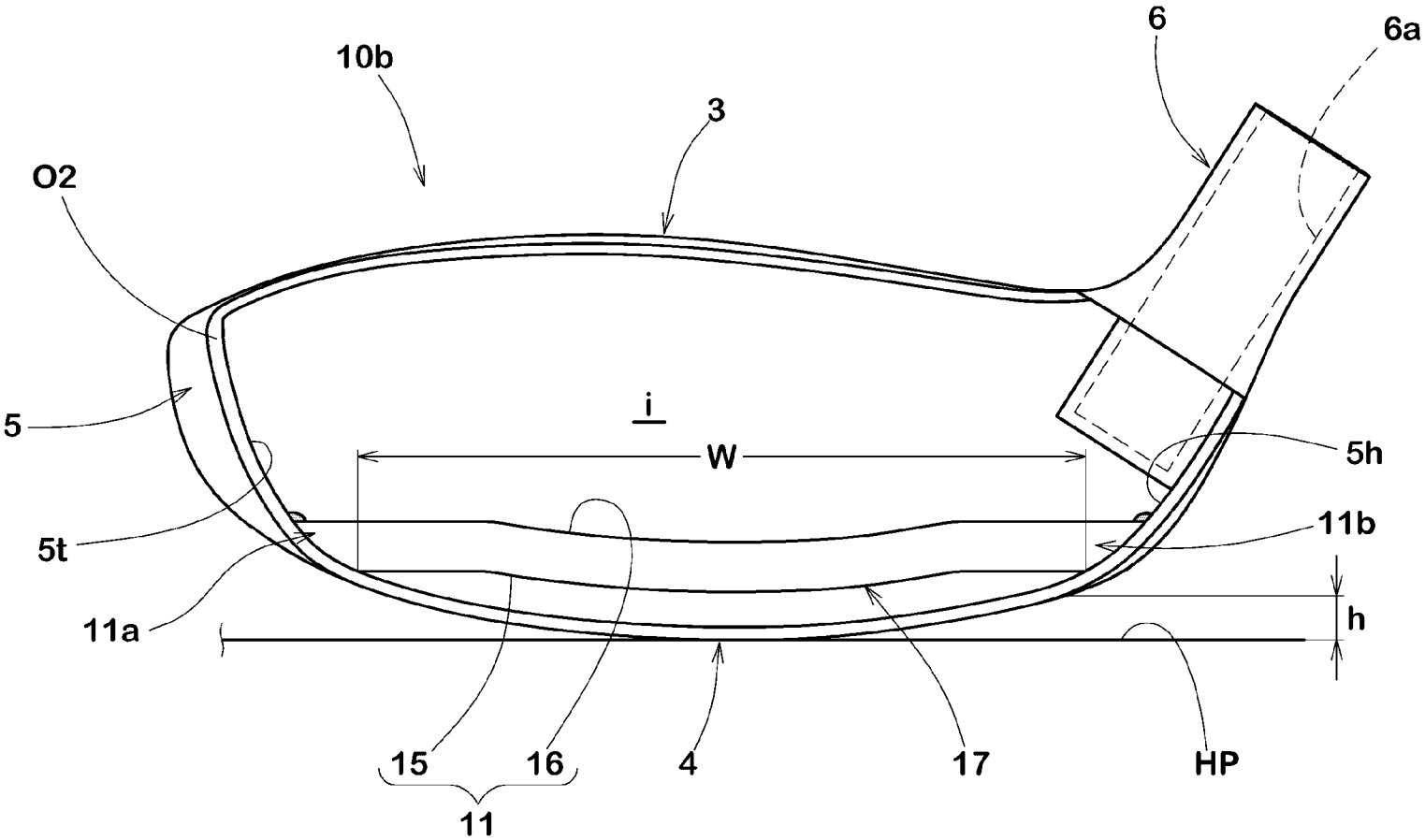
FIG. 4 is a front view of the rear side member shown in FIG. 3.

FIG. 4 is a front view of the rear member 10*b*.

The weight member 11 has a toe side end a fixed to a toe side part of the head main body 10 and a heel side end portion 11*b* fixed to a heel side part of the head main body 10. The weight member 11 extends continuously between the toe side end portion 11*a* and the heel side end portion 11*b*. For example, the toe side end portion 11*a* is fixed to the inner surface 5*t* of a toe side part of the side portion 5 in the rear member 10*b*. The heel side end portion 11*b* is fixed to the inner surface 5*h* of a heel side part of the side portion 5 in the rear member 10*b*.

Except for the end portions 11*a* and 11*b*, the weight member 11 does not contact with the inner surface of the head main body 10. Thus, within the hollow i, the weight member 11 is bridged like a rod spaced apart from the inner surface of the head main body 10 continuously between the end portions 11*a* and 11*b*.

As to the boundary between the sole portion 4 and the side portion 5, if a distinguishable edge exists on the outer surface of the head, then the boundary is defined by the edge. If a distinguishable edge does not exist but a significant change in the curvature of the outer surface of the head exists, then the boundary is defined by the position where such significant change occurs.

If a distinguishable edge and a significant change in the curvature do not exist, then the boundary is defined as existing at a height h of 4 mm from the horizontal plane HP as shown in FIGS. 2 and 4.

In this embodiment, the head main body 10 and the weight member 11 are integrally formed, for example, by casting. Aside from such integral formation, a welding technique can be used to join the weight member 11 and the head main body 10. In this case, it is possible to use the weight member 11 made of a material having a specific gravity higher than that of the head main body 10 in order that the center of gravity of the weight member 11 further approaches to the sole portion.

As shown in FIGS. 2 and 4, the weight member 11 has a bottom surface 15 facing the sole portion and an upper surface 16 facing the crown portion, and in this embodiment, the cross-sectional shape of the weight member 11 is substantially rectangular.

Aside form such rectangular shape, for example, a circular shape, elliptical shape, triangular shape, parallelogram shape, trapezoidal shape etc. may be employed.

In the front view of the weight member 11 under the standard state of the head, the upper surface 16 of the weight member 11 may extend straight and substantially parallel with the toe-heel direction. In this embodiment, however, the upper face 16 includes a curved part which is concave toward the sole portion 4.

The bottom surface 15 of the weight member 11 may extend straight and substantially parallel with the toe-heel direction. In this embodiment, however, the bottom surface 15 include a curved part 17 which is convex toward the sole portion 4. Thus, the weight member 11 in this embodiment serves to further lower the center CG of gravity of the head.

Figure 5:
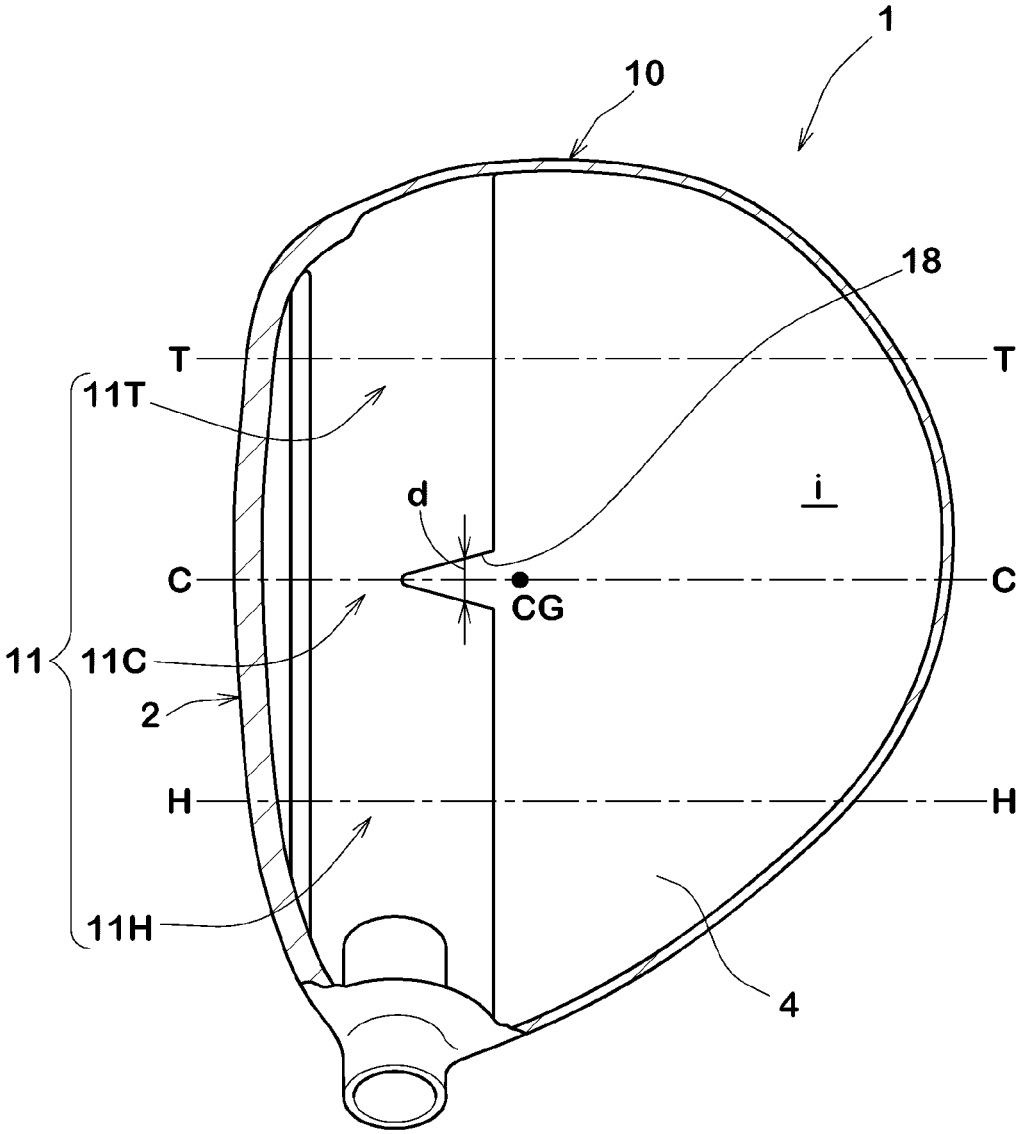
FIG. 5 is a horizontal sectional view of the golf club head shown in FIG. 1.

FIG. 5 shows a horizontal cross-section of the head 1 parallel with the horizontal plane HP.

Figure 6A:
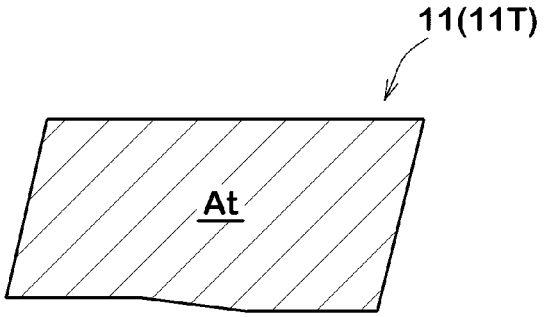
FIGS. 6(*a*), 6(*b*) and 6(*c*) are cross-sectional views of the weight member taken along line T-T, line C-C and line H-H in FIG. 5, respectively.
Figure 6B:
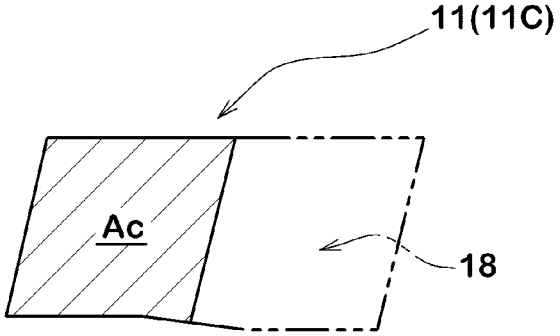
Figure 6C:
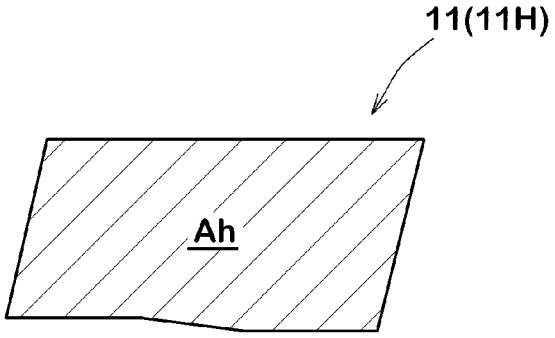

FIGS. 6(*a*), 6(*b*) and 6(*c*) show vertical cross-sections of a toe side portion 11T, a central portion 11C and a heel side portion 11H of the weight member taken along line T-T, line C-C and line H-H in FIG. 5, respectively.

The C-C line cross-section is at the same position as the above-mentioned vertical plane including the sweet spot SS and the center of gravity of the head 1. The central portion 11*c* includes the position of the vertical plan including the sweet spot SS and the center of gravity of the head 1.

The T-T line cross-section and the H-H line cross-section are spaced apart from the C-C line cross-section by a distance of 30% of the length in the toe-heel direction of the upper surface 16 of the weight member 11.

As shown in FIGS. 5 and 6, the cross-sectional area Ac of the central portion 11*c* is smaller than the cross-sectional area Ah of the heel side portion 11H and the cross sectional area At of the toe side portion 11T.

Such weight member 11 can distribute a weight to the toe side and heel side portions 11T and 11H more than the center portion 11*c*. Therefore, in the head 1 in this embodiment, it is possible to achieve both of a shallow center CG of gravity and a large moment of inertia.

In order to enhance such effect, the minimum cross-sectional area Ac in the central portion 11C is not more than 80%, preferably not more than 70%, more preferably not more than 60% of the maximum cross-sectional area in the heel side portion 11H and the maximum cross-sectional area in the toe side portion 11T.

In this embodiment, the maximum cross-sectional area in the heel side portion 11H is substantially the same as the maximum cross-sectional area in the toe side portion 11T, and the minimum cross-sectional area Ac is about 50% of the maximum cross-sectional area.

In the example of the weight member 11 shown in FIG. 5, the weight member 11 is provided with a concave portion 18 recessed toward the face portion 2. Thus, the central portion 11C of the weight member 11 has a smaller width in the front-back direction of the head as compared to other portions, and thus, the cross-sectional area (weight) is reduced.

In this embodiment, the concave portion 18 is substantially V-shaped in the plane view.

In the plane view, the concave portion 18 is preferably positioned on a line which extends in the front-back direction through the center CG of gravity of the head, and on the front side of the center CG of gravity of the head.

More preferably, the apex of the v-shape of the concave portion 18 is positioned on the line extending through the center CG of gravity, therefore, the weight member 11 has the smallest cross-sectional area in the central portion 11C, and the cross-sectional area is increased smoothly therefrom toward the toe side portion 11T and the heel side portion 11H.

Still more preferably, the width d of the concave portion 18 in the toe-heel direction of the head is gradually increased toward the backward of the head.

Such weight member 11 can distribute more weight to more distant positions on the toe side and the heel side from the center CG of gravity of the head.

Figure 7:
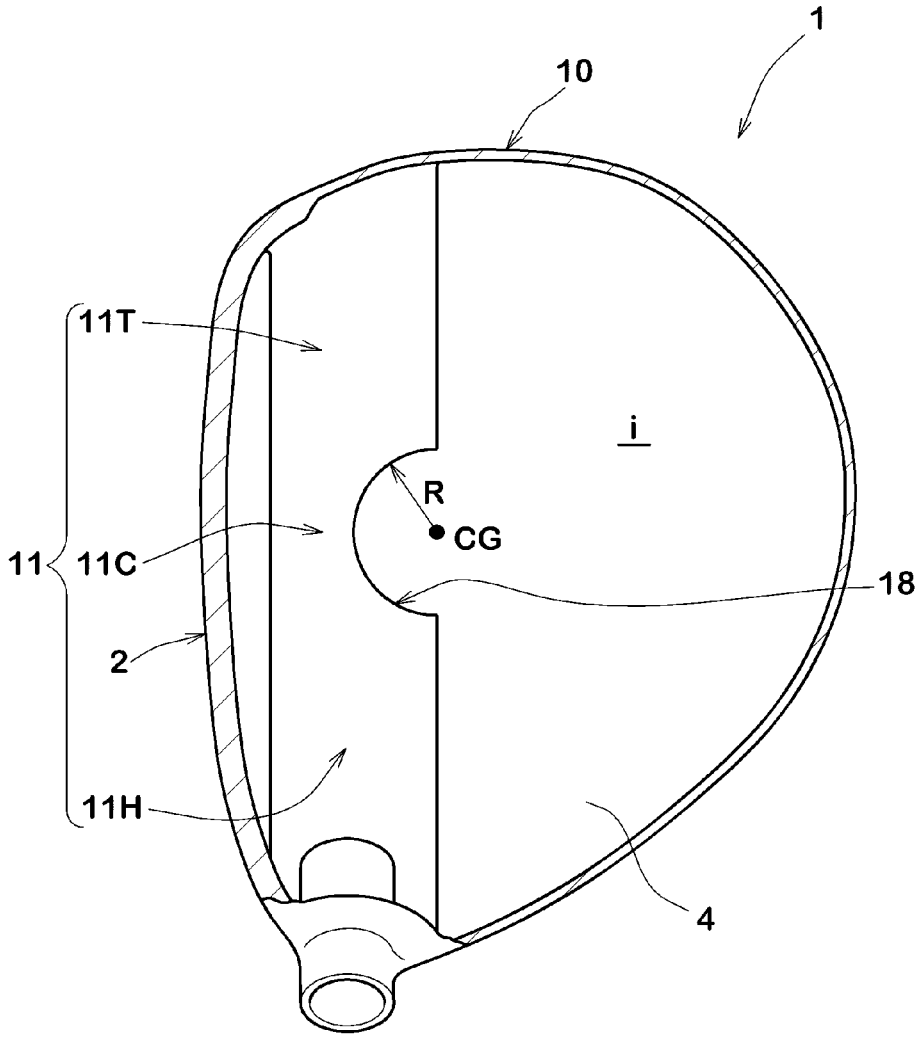
FIG. 7 is a horizontal sectional view of a golf club head as another embodiment of the first aspect of the present invention showing another example of the weight member.

FIG. 7 shows another example of the concave portion 18 of the weight member 11. In this example, in the plan view, the concave portion 18 has an arcuate shape which is concave toward the face portion 2. The arcuate shape has a center and a radius R. The center is preferably positioned near the center CG of gravity of the head in the plan view. For example, the distance therebetween in the plan view is not more than 5.0 mm, preferably not more than 3.0 mm, more preferably not more than 2.0 mm, still more preferably not more than 1.0 mm, yet still more preferably not more than 0.5 mm, most preferably zero.

Figure 8:
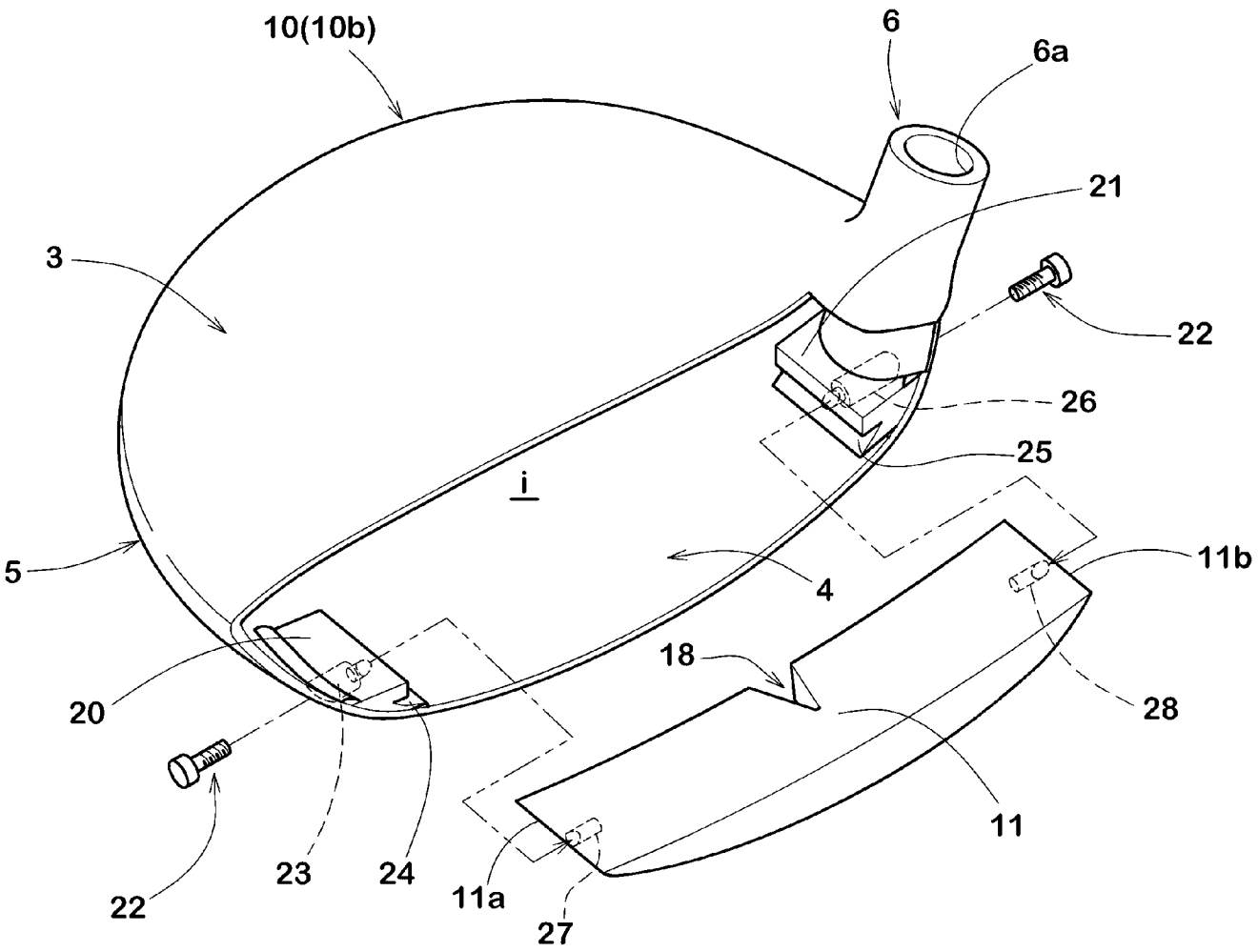
FIG. 8 is an exploded perspective view of a golf club head as another embodiment of the first aspect of the present invention showing another example of the weight member.
Figure 9:
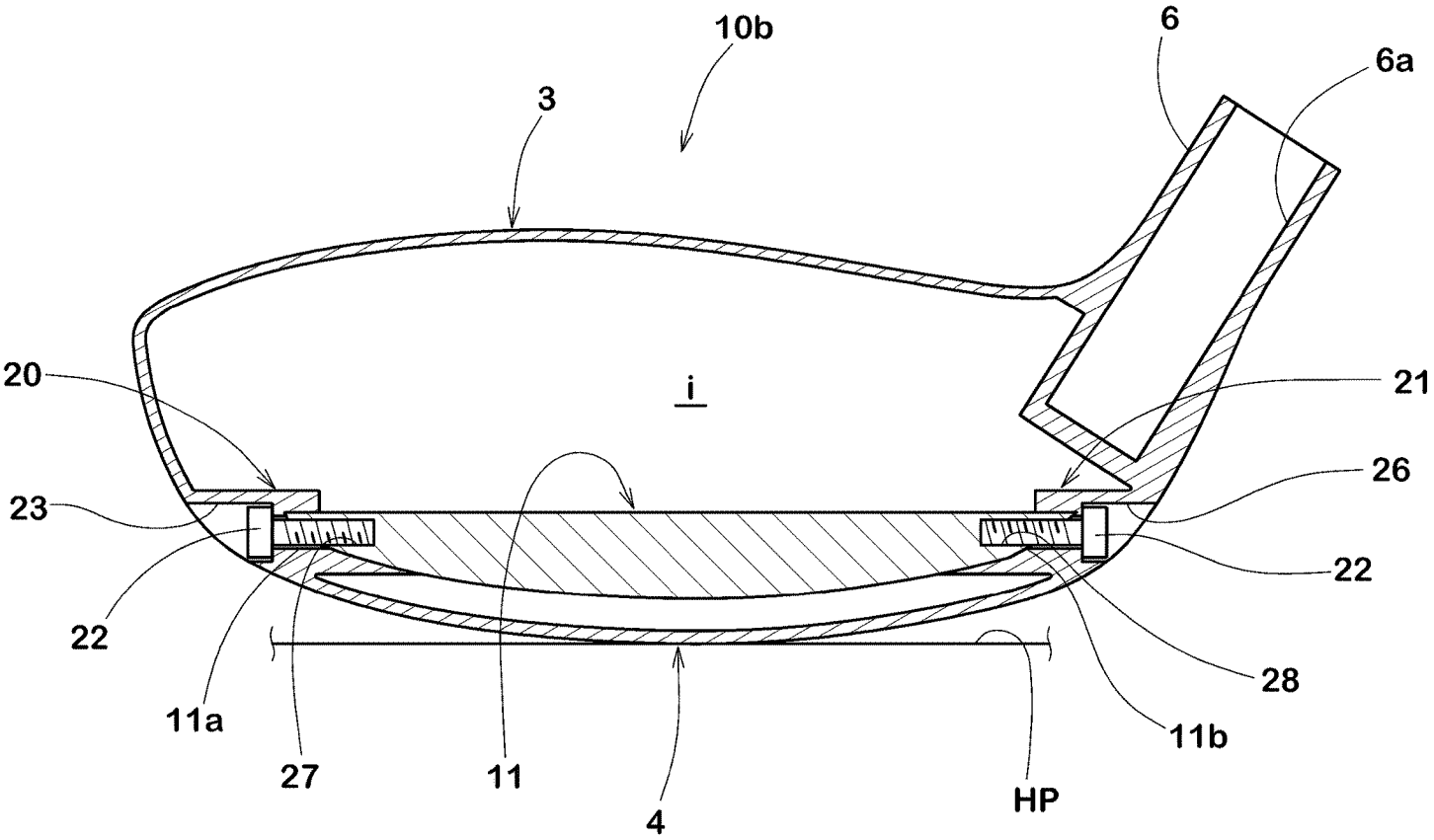
FIG. 9 is a sectional view of the golf club head shown in FIG. 8.

FIGS. 8 and 9 show another example of the method for fixing the weight member 11 to the head main body 10.

In this example, by using screws 22, the weight member 11 is fixed to the rear member 10*b* of the head main body 10.

The rear member 10*b* is provided in its toe side and heel side parts of the side portion 5 with a toe side mounting portion 20 and a heel side mounting portion 21 for mounting the weight member 11.

The toe side mounting portion 20 is provided with a groove 24 into which the toe side end portion 11*a* of the weight member 11 can be inserted from the front side, and a through hole 23 through which the screw 22 is installed to the weight member 11. The through hole 23 extends in the toe-heel direction and penetrates through the toe side mounting portion 20.

The heel side mounting portion 21 is provided with a groove 25 into which the heel side end portion 11*b* of the weight member 11 can be inserted from the front side, and a through hole 26 through which the screw 22 is installed to the weight member 11. The through hole 26 extends in the toe-heel direction and penetrates through the heel side mounting portion 21.

The toe side end portion 11*a* and the heel side end portion 11*b* of the weight member 11 are provided with threaded holes 27 and 28, respectively.

The weight member 11 is inserted in the grooves 24 and 25 of the mounting portions 20 and 21 from the front side, and the weight member 11 is temporarily held in the rear member 10*b* of the head main body 10. Then, the screws 22 are inserted in the holes 23 and 26 and fixed to the threaded holes 27, 28 of the weight member 11 as shown in FIG. 9.

In this example, the screw and/or the weight member 11 can be made of a material having a specific gravity higher than that of the head main body 10 in order to distribute more mass to the toe side and heel side of the head 1 and thereby to provide a larger moment of inertia for the head 1.

Figure 10:
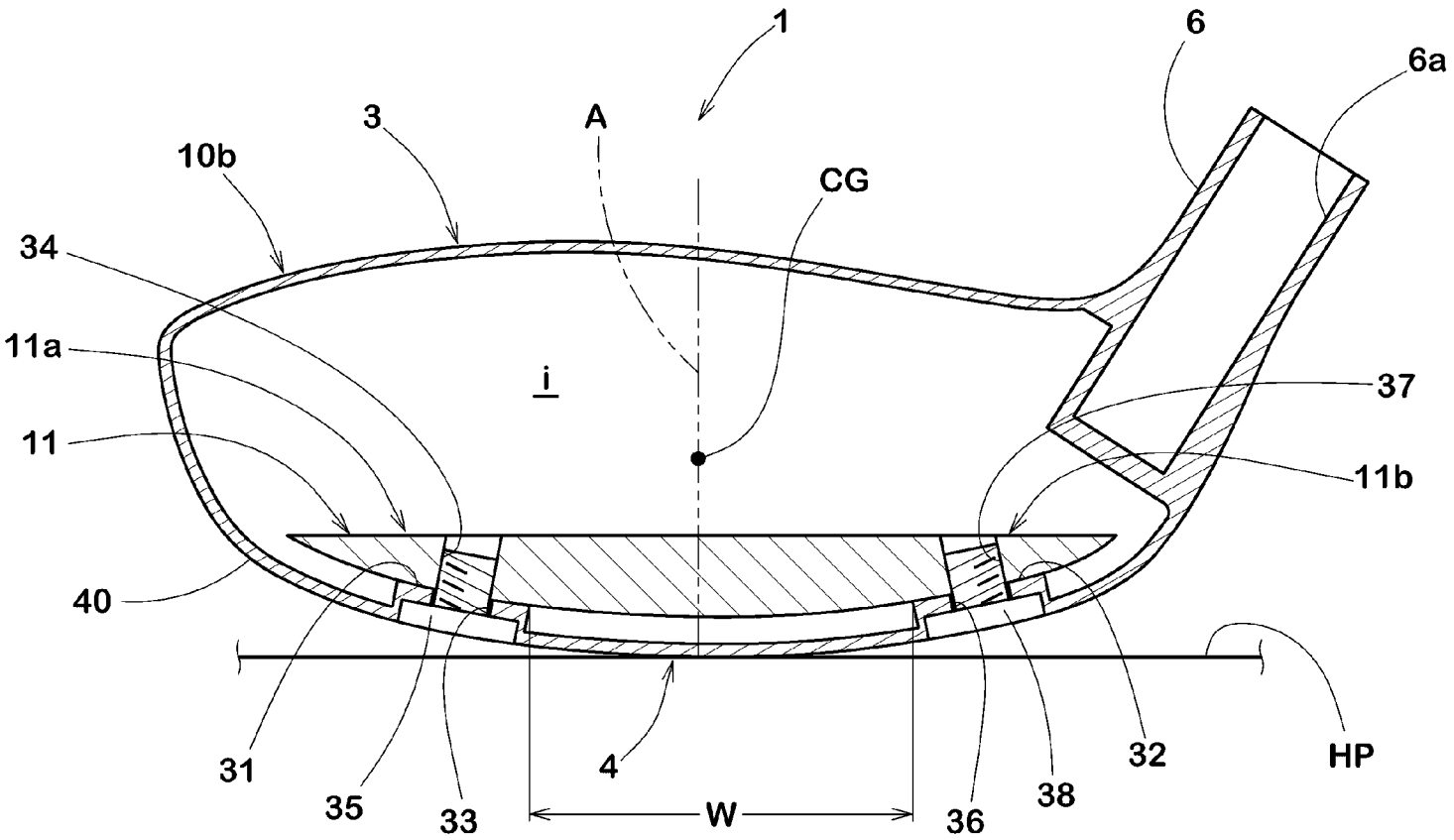
FIG. 10 is a cross-sectional view of a golf club head as another embodiment of the first aspect of the present invention showing another example of the weight member.

FIG. 10 shows another embodiment of the first aspect of the present invention. In this embodiment, the weight member 11 is fixed by using screws to the sole portion 4 of the head main body 10. The sole portion 4 of the rear member 10*b* is provided with a toe-side mounting portion 31 and a heel side mounting portion 32 for mounting the weight member 11.

The toe side mounting portion 31 is formed as a convex portion protruding into the hollow i by locally denting the outer surface 40 of the head. The convex portion supports the toe side end portion 11*a* of the weight member 11 from the under side.

The heel side mounting portion 32 is formed as a convex portion protruding into the hollow i by locally denting the outer surface 40 of the head. The convex portion supports the heel side end portion 11*b* of the weight member 11 from the under side.

Thus, the weight member 11 is supported by the toe side mounting portion 31 and the heel side mounting portion 32, and between the mounting portions 31 and 32, the weight member 11 does not contact with the inner surface of the sole portion 4.

The toe side mounting portion 31 and the heel side mounting portion 32 are provided with through holes 33 and 36, respectively. The weight member 11 is provided with threaded holes 34 and 37 aligned with the through holes 33 and 36. Screws 35 and 38 are instead into the through holes 33 and 36 from the outer side of the sole portion 4 and are secured to the threaded holes 34 and 37.

In this embodiment, although the weight member 11 is fixed to the sole portion 4, it is possible to achieve the above-described effects because the weight member 11 is separated from the head main body 10 over a wide range including the above-mentioned vertical plane including the center of gravity of the head 1.

In all of the embodiments of the first aspect of the present invention, when measured in the front view of the head, a length W in the toe-heel direction of the part of the weight member 11 separated from the head main body 10 is not less than 35%, preferably not less than 40%, more preferably not less than 50% of the head width, wherein the head width is defined by the distance in the toe-heel direction between the toe side most end of the head and a heel side point defined as being positioned on the outer surface of the head at a vertical height of 22.23 mm from the horizontal plane HP in the front view of the head under the standard state.

Second Aspect of the Invention

Next, embodiments of the second aspect of the invention will be described. As to the same components as those described in the embodiments of the first aspect, the same reference numerals are assigned thereto, and redundant descriptions are omitted.

Figure 11:
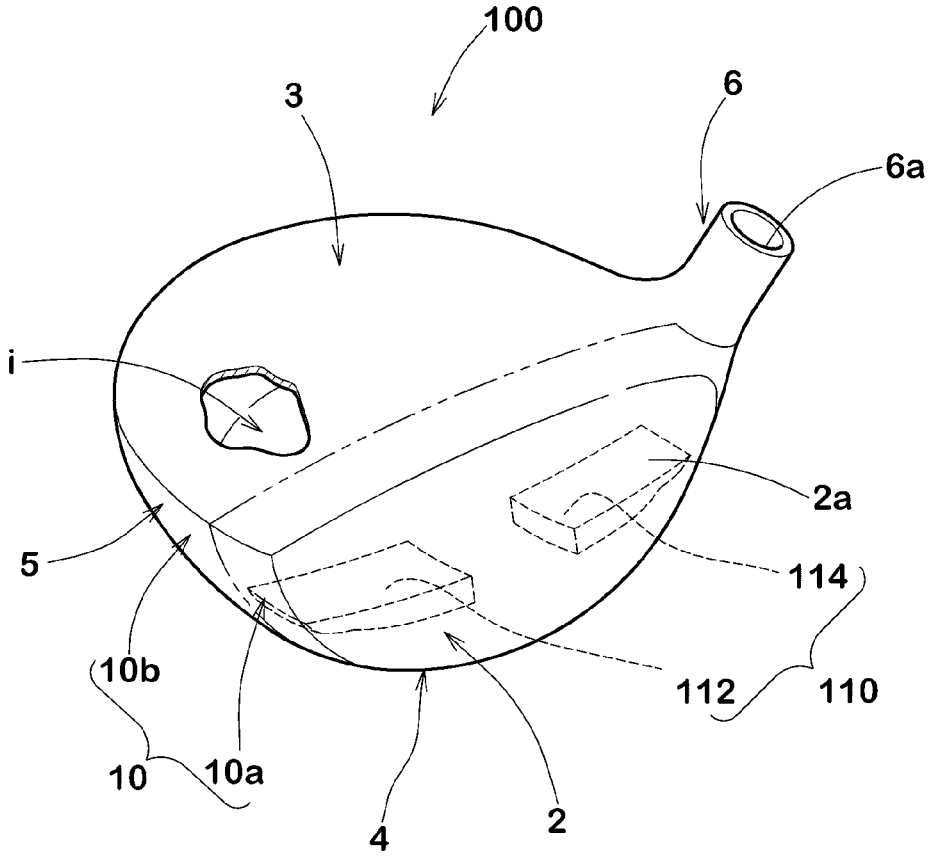
FIG. 11 is a perspective view of a golf club head as an embodiment of the second aspect of the present invention.

FIG. 11 is a perspective view of a golf club head 100 as an embodiment of the second aspect of the present invention.

In this embodiment, too, the head 100 is for a wood type golf club. But, the second aspect is not limited to such wood type.

The golf club head 100 comprises a face portion 2, a crown portion 3, a sole portion 4, and a side portion 5 so as to define a hollow i therein.

The head 100 is composed of a head main body 10, and weight members 110 disposed in the hollow i of the head main body 10.

As to the structure of the head main body 10, those described in the embodiments of the first aspect may be employed in this embodiment.

Figure 12:
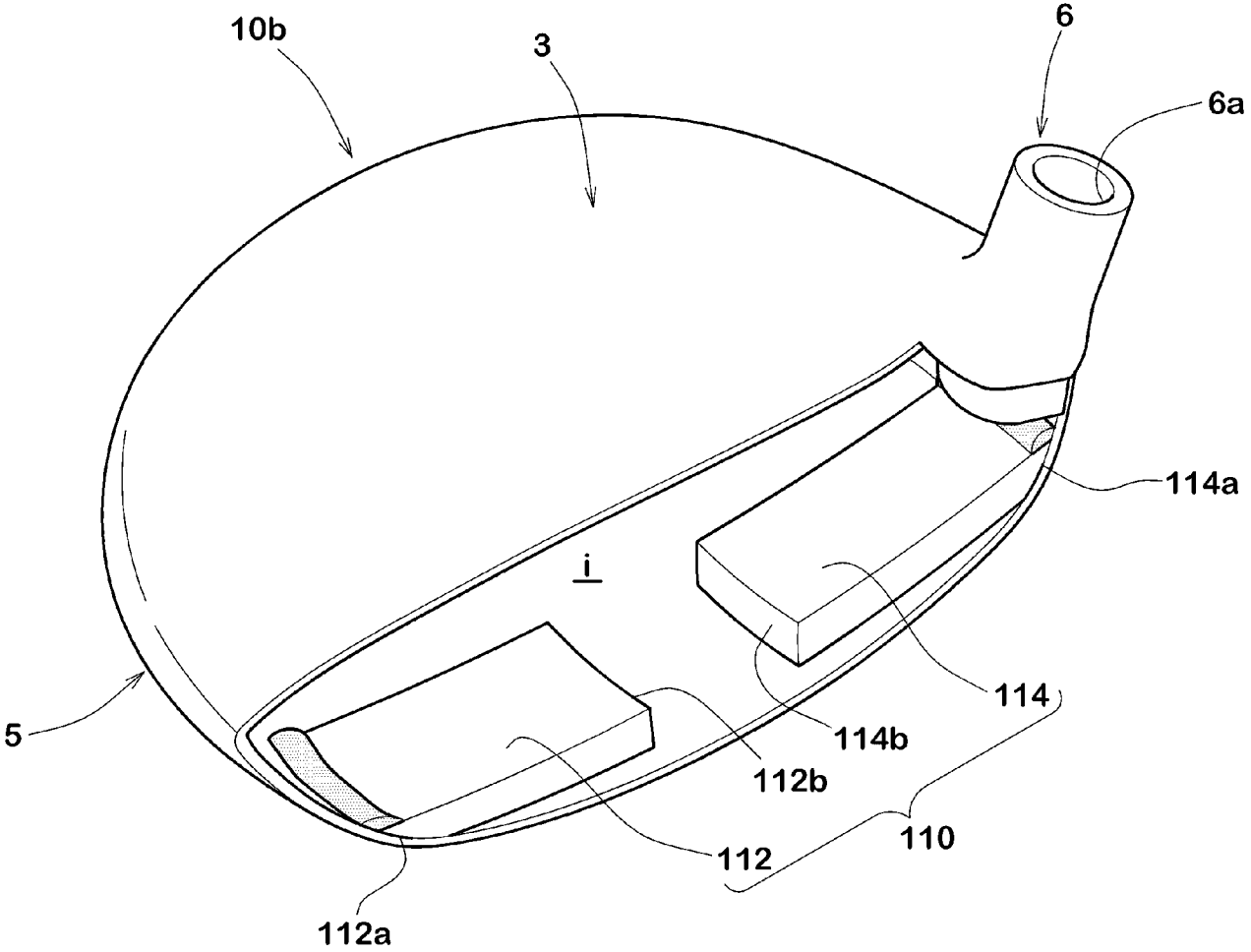
FIG. 12 is a perspective view of a rear side member of the golf club head shown in FIG. 11.
Figure 13:
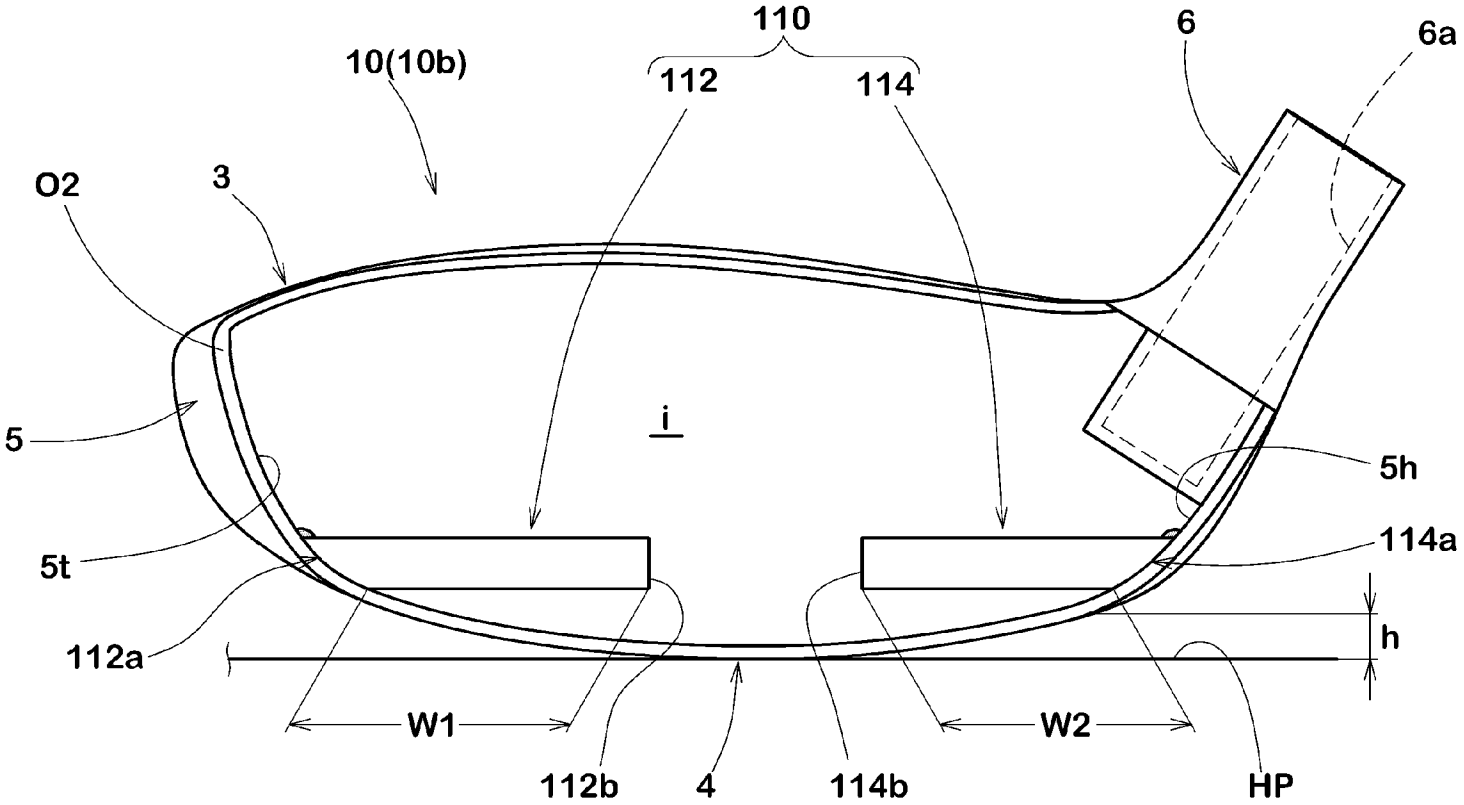
FIG. 13 is a front view of the rear side member shown in FIG. 12.
Figure 14:
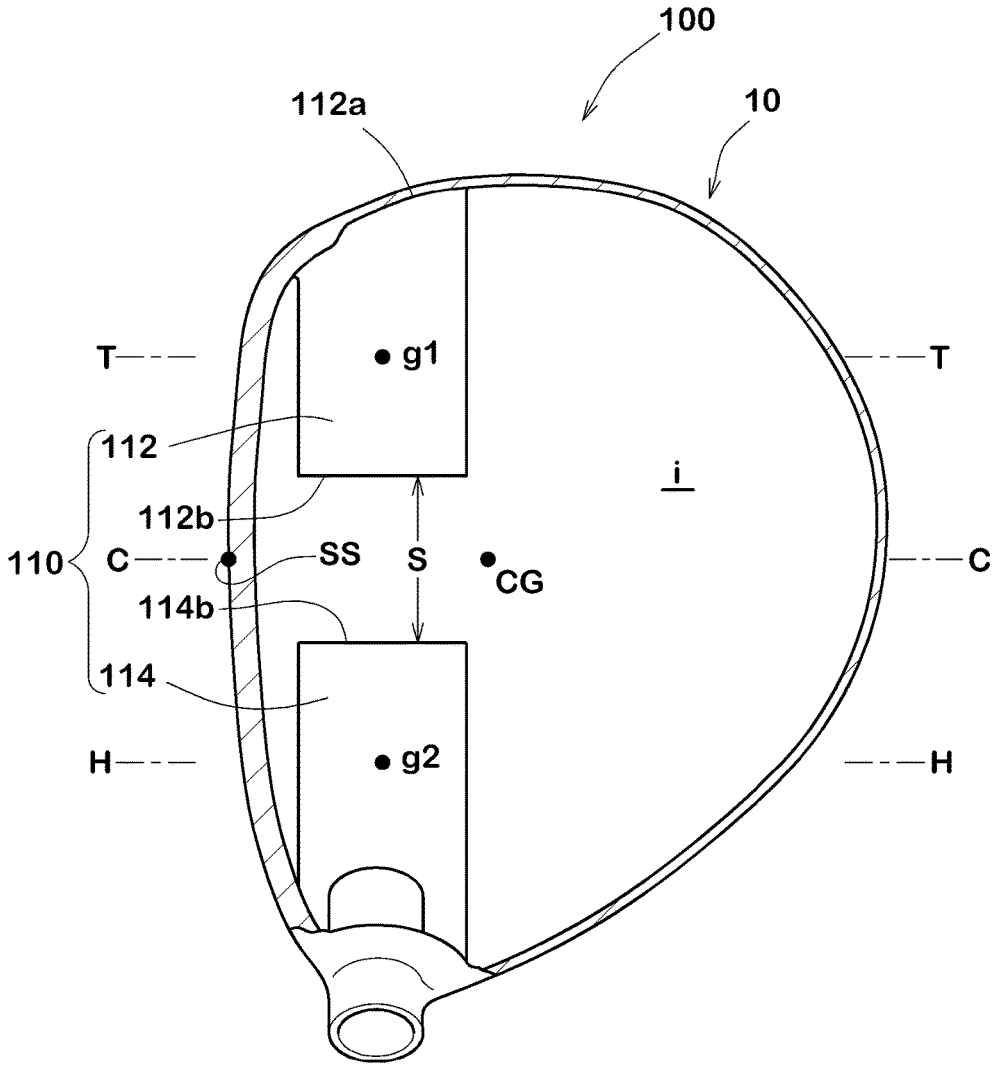
FIG. 14 is a horizontal sectional view of the golf club head shown in FIG. 11.

FIG. 12 is a perspective view of the rear member 10*b* of the head main body 10. FIG. 13 is a front view of the rear member 10*b*. FIG. 14 is a horizontal sectional view of the head 100.

As shown in FIGS. 12, 13 and 14, the weight members 110 include a toe side weight member 112 and a heel side weight member 114.

As shown in FIG. 13, the toe side weight member 112 has a toe side end portion 112*a* fixed to a toe side part of the head main body 10, and a heel side end 112*b* terminating within the hollow i. The toe side weight member 112 contacts with the head main body 10 only at the toe side end portion 112*a*, and extends therefrom to the heel side end 112*b* without contacting with the inner surface of the head main body 10.

As in this embodiment, a length in the toe-heel direction of the toe side weight member 112 is preferably larger than a maximum dimension in the front-back direction of the toe side weight member 112 (the maximum dimension is the diameter if the cross section is circular).

The heel side weight member 114 has a heel side end portion 114*a* fixed to a heel side part of the head main body 10, and a toe side end 114*b* terminating within the hollow i.

The heel side weight member 114 contacts with the head main body 10 only at the heel side end portion 114*a*, and extends therefrom to the toe side end 114*b* without contacting with the inner surface of the head main body 10.

As in this embodiment, a length in the toe-heel direction of the heel side weight member 114 is preferably larger than a maximum dimension in the front-back direction of the heel side weight member 114.

Figure 15A:
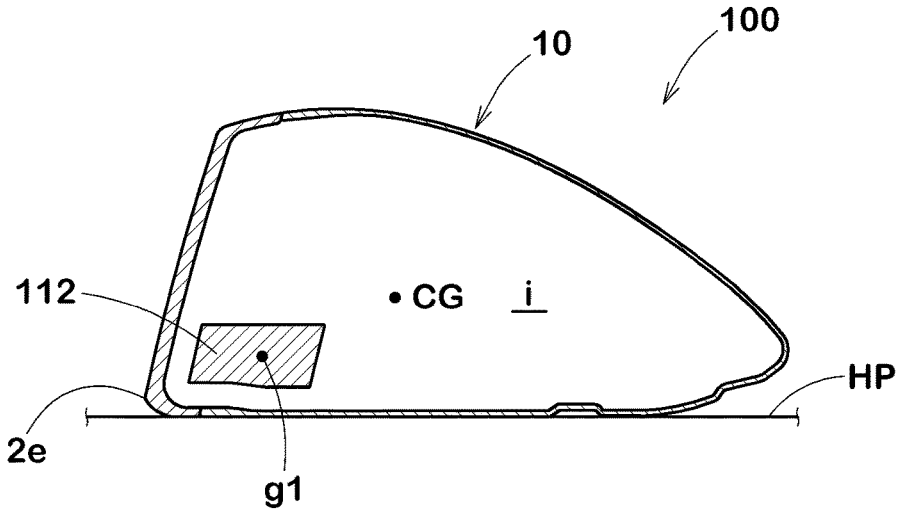
FIGS. 15(*a*) and 15(*b*) are cross-sectional views taken along line T-T and line H-H of FIG. 14, respectively.
Figure 15B:
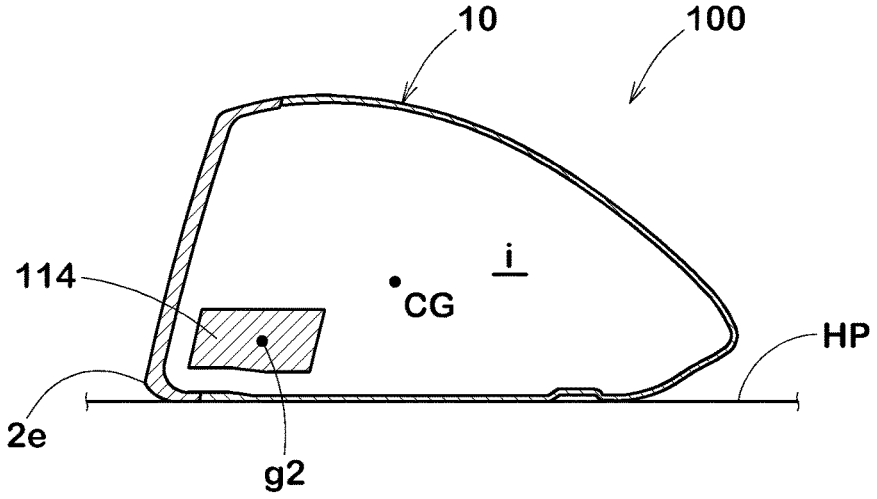

FIGS. 15(*a*) and 15(*b*) show vertical cross-sections of the toe side weight member 112 and the heel side weight member 114 taken along line T-T and line H-H of FIG. 14, respectively. As shown, void is formed around the toe side weight member 112 and the heel side weight member 114. Accordingly, the weight members are arranged as if they are floating in the air in the hollow i.

In order that the head main body 10 does not contact with the weight members even if the head main body 10 is elastically deformed by striking a ball, the minimum distance therebetween is set in a range of not less than 1 mm, preferably not less than 2 mm, more preferably not less than 3 mm.

In this embodiment too, it is desirable that the weight members 110 are arranged so as to approach to a corner between the face portion 2 and the sole portion 4 or approach to the leading edge 2*e* of the head.

Preferably, the center g1 of gravity of the toe side weight member 112 is positioned on the face portion 2 side and on the sole portion 4 side of the center CG of gravity of the head, and the center g2 of gravity of the heel side weight member 114 is positioned on the face portion 2 side and on the sole portion 4 side of the center CG of gravity of the head.

More preferably, the entirety of the toe side weight member 112 and the entirety of the heel-side weight member 114 are positioned on the sole portion 4 side of the center CG of gravity of the head.

More preferably, the entirety of the toe side weight member 112 and the entirety of the heel-side weight member 114 are positioned on the face portion 2 side of the center CG of gravity of the head.

Accordingly, the center CG of gravity of such head 1 becomes low and shallow, therefore, it is possible to hit a golf ball with a trajectory preferred by the experienced golfers, namely, a trajectory achieved by a low spin rate.

As shown in FIGS. 13 and 14, the heel side end 112*b* of the toe side weight member 112 and the toe side end 114*b* of the heel side weight member 114 face each other with a space therebetween.

In this embodiment, the first end 112*b* and the toe side end 114*b* are spaced apart from each other in the toe-heel direction, namely, the two weight members 112 and 114 are not overlapped with each other in the toe-heel direction.

Each weight member 112, 114 is formed like a cantilever.

In the head 100 according to the second aspect of the invention, when hitting a ball with the club face 2*a*, the face portion 2 and the sole portion 4 can be deflected without being hindered by the weight members 110. Further, the weight members 110 do not excessively increase the rigidity of the crown portion 3 and the sole portion 4, therefore, the crown portion 3 and the sole portion 4 can deflect flexibly when hitting a ball, and the head 100 can exhibit excellent rebound performance.

In this embodiment, each of the weight members 112 and 114 does not extend across the above-mentioned vertical plane including the sweet spot SS and the center of gravity of the head, and the heel side end 112*b* and the toe side end 114*b* are terminated before the vertical plane.

Therefore, if the total mass of the weight members 112 and 114 is the same as that of the weight member 11 in the first aspect of the invention, the weight between the heel side end 112*b* and the toe side end 114*b* is allocated to the toe side weight member 112 and the heel side weight member 114. Thus, the moment of inertia of the head 100 can be increased more than the head 1 according to the first aspect, while achieving a shallow center of gravity.

In all of the embodiments of the second aspect of the present invention, when measured in the front view of the head as shown in FIG. 13, the sum of lengths W1 and W2 is not less than 12.5%, preferably not less than 20%, more preferably not less than 30% of the above-mentioned head width, wherein W1 is a length in the toe-heel direction of the part of the toe side weight member 112 separated from the head main body 10, and W2 is a length in the toe-heel direction of the part of the heel side weight member 114 separated from the head main body 10.

The length W3 in the toe-heel direction between the heel side end 112*b* and the second end portion 114*b* is preferably not less than 10 mm, more preferably not less than 15 mm in the plan view.

The head 100 according to the second aspect of the present invention preferably has a depth of the center of gravity which is more than the face progression and not less than 27.0 mm, and a moment of inertia which is not less than 2700 g sq. cm.

Figure 16:
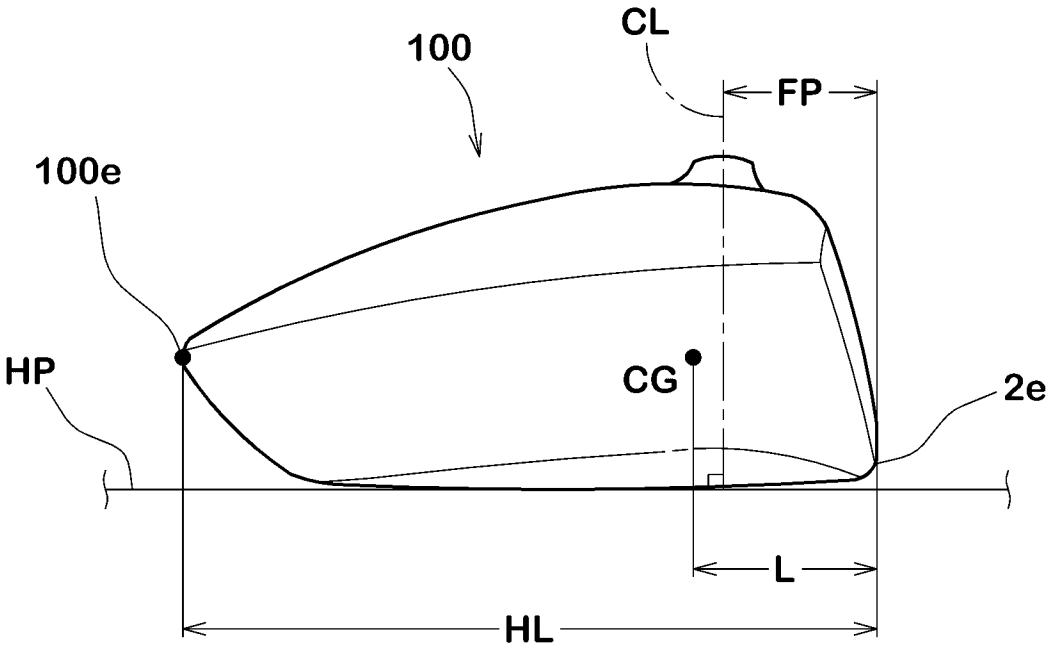
FIG. 16 is a side view of the golf club head under its standard state.

Here, the depth of the center of gravity of the head is, as shown in FIG. 16, a distance L in the front-back direction measured from the leading edge 2*e* to the center CG of gravity of the head.

The face progression is, as shown in FIG. 16, a distance FP in the front-back direction measured from the leading edge 2*e* to the axis CL of the golf club shaft.

The moment of inertia is a moment of inertia about a vertical axis passing through the center CG of gravity of the head.

The reason for adopting the face progression as a lower limit of the depth of the center of gravity is that, if the center CG of gravity of the head is located in front of the axis CL the club shaft, there is a possibility that the loft angle becomes smaller when striking a ball.

Typical examples of the face progression (FP) are as follows.

driver (#1) whose loft angle is 9.5 degrees: 19.5 mm
driver (#1) whose loft angle is 10.5 degrees: 20.4 mm
fairway wood (#3): 16.5 mm
fairway wood (#4): 17.5 mm
fairway wood (#5): 18.5 mm
utility type club (hybrid) (#3): 13.1 mm
utility type club (hybrid) (#4): 14.0 mm
utility type club (hybrid) (#5): 14.9 mm Golf club heads which satisfy the USGA Golf Rules were measured for the depth of the center of gravity and the moment of inertia. The results are plotted in a scatter diagram shown in FIG. 17.

Figure 17:
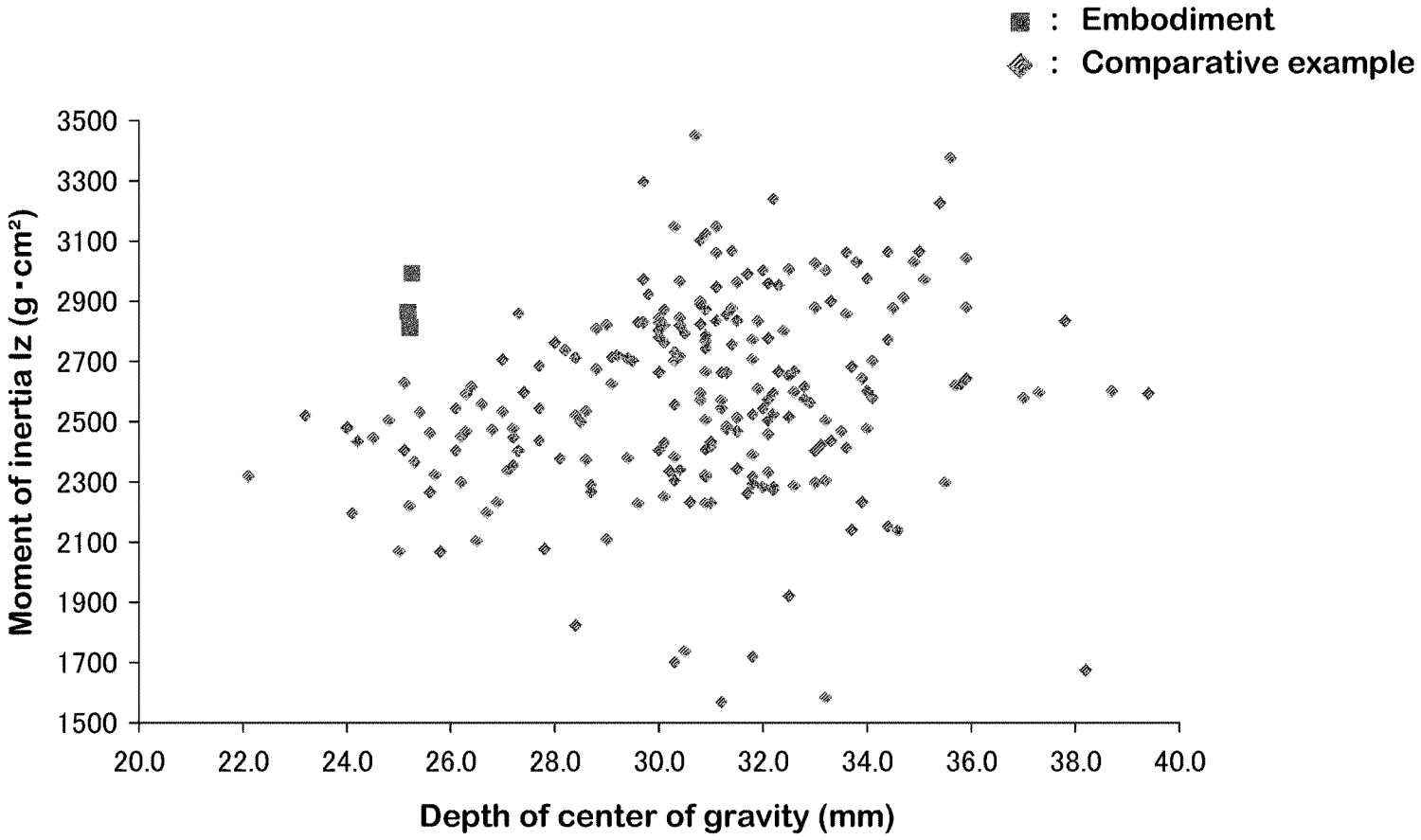
FIG. 17 is a graph showing a relationship between the depth of the center of gravity and the moment of inertia.

As can be seen from FIG. 17, in the comparative golf club heads, there is a tendency that if the depth of the center of gravity is reduced, the moment of inertia is also reduced, and especially, if the depth of the center of gravity is less than 27.0 mm, the moment of inertia is at most about 2600 g sq. cm. In contrast, in the heads 100 according to the second aspect of the present invention, a large moment of inertia of more than 2700 g sq. cm or more than 2800 g sq. cm is possible.

The fact that such a large moment of inertia and such a shallow depth of the center of gravity can be obtained at the same time is the remarkable effect of the second aspect of the present invention.

Such a head can achieve a trajectory characteristic of a low backspin, and at the same time, can reduce a small rotation of the head around a vertical axis passing through the center of gravity of the head which is caused by off-center shot, to thereby suppress the side spin of the ball. Thus, the head 100 is excellent in the directionality of the hit ball.

More preferably, the moment of inertia of the head 100 is set in a range of not less than 2750 g sq. cm, still more preferably not less than 2800 g sq. cm.

More preferably, the depth of the center of gravity of the head 100 is set in a range of not more than 26.5 mm, still more preferably not more than 26.0 mm.

Preferably, the head 100 in this embodiment is formed to satisfy the following condition:

a percentage depth of the center of gravity is not less than {100×the face progression FP/a maximum dimension HL of the head in the front-back direction} % and not more than 33.0%, wherein the percentage depth of the center of gravity is the rate as a percentage of the depth (mm) of the center of gravity of the head to the maximum dimension HL (mm) of the head in the front-back direction.

The maximum dimension HL of the head in the front-back direction is, as shown in FIG. 16, a distance in the front-back direction measured from the leading edge 2*e* to the rearmost end 100*e* of the head 100. Such percentage depth of the center of gravity indicates a position of the center of gravity relatively to the dimension of the head in the front-back direction. Thus, the smaller the value, the shallower the center of gravity. If the percentage depth is less than (100×the face progression FP/the maximum dimension HL), there is a possibility that the loft angle becomes smaller during striking a ball.

Figure 18:
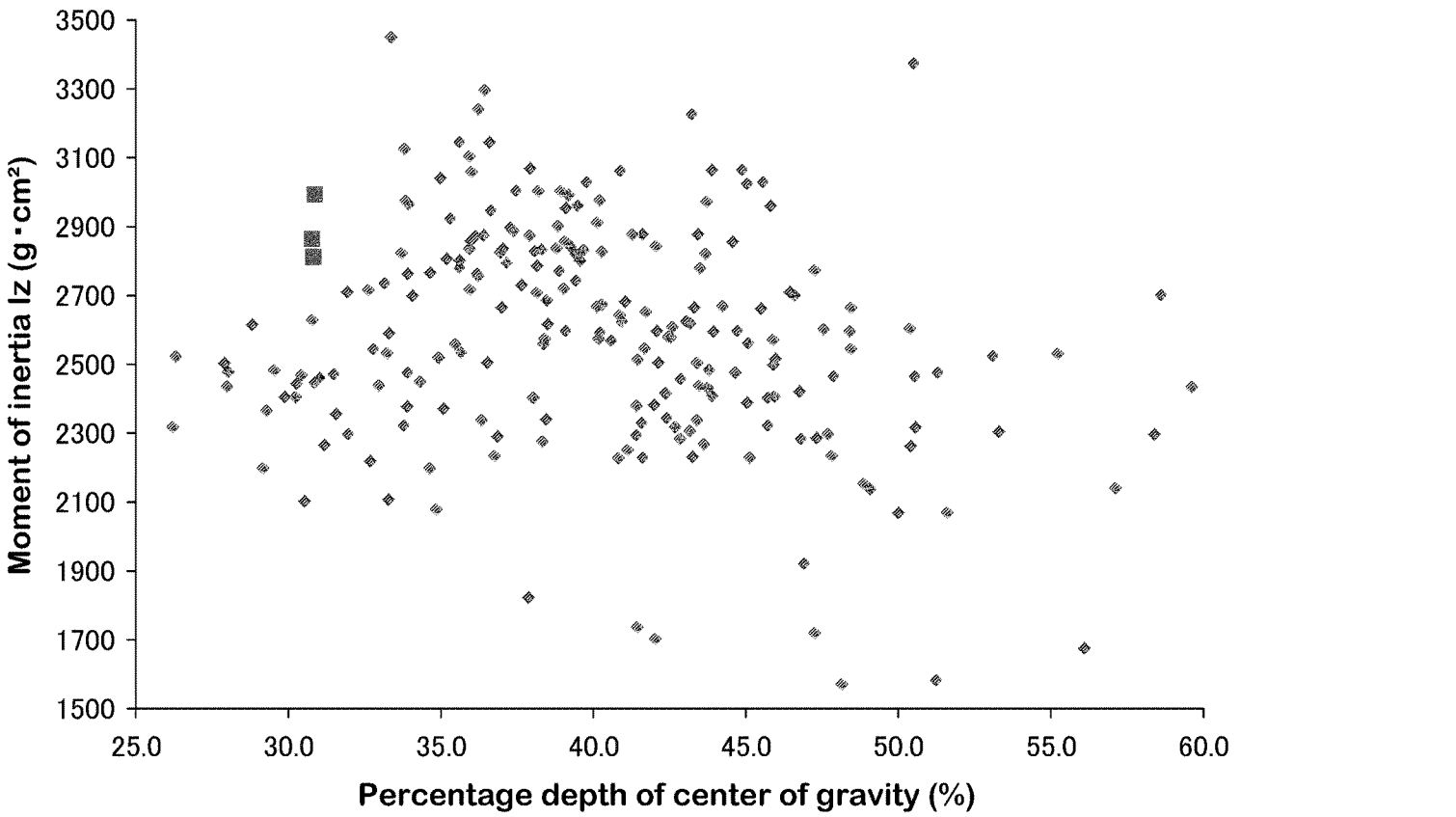
FIG. 18 is a graph showing a relationship between the percentage depth of the center of gravity and the moment of inertia.

FIG. 18 is a scatter diagram in which the percentage depth of the center of gravity and the moment of inertia of the above-mentioned golf club heads are plotted.

As apparent from FIG. 18, in the heads 100 according to the second aspect of the present invention, the moment of inertia of more than 2700 g sq. cm can be obtained although the percentage depth of the center of gravity is less than 33.0%.

The fact that such a large moment of inertia and such a small percentage depth can be obtained at the same time is the remarkable effect of the second aspect of the present invention.

Most preferably, the percentage depth of the center of gravity is not more than 32.0%.

In the example of the weight members 110 shown in FIG. 14, the heel side end 112*b* of the toe side weight member 112 and the toe side end 114*b* of the heel side weight member 114 are parallel with the front-back direction in the plan view, and the distance s or space therebetween is substantially constant in the front-back direction.

Figure 19:
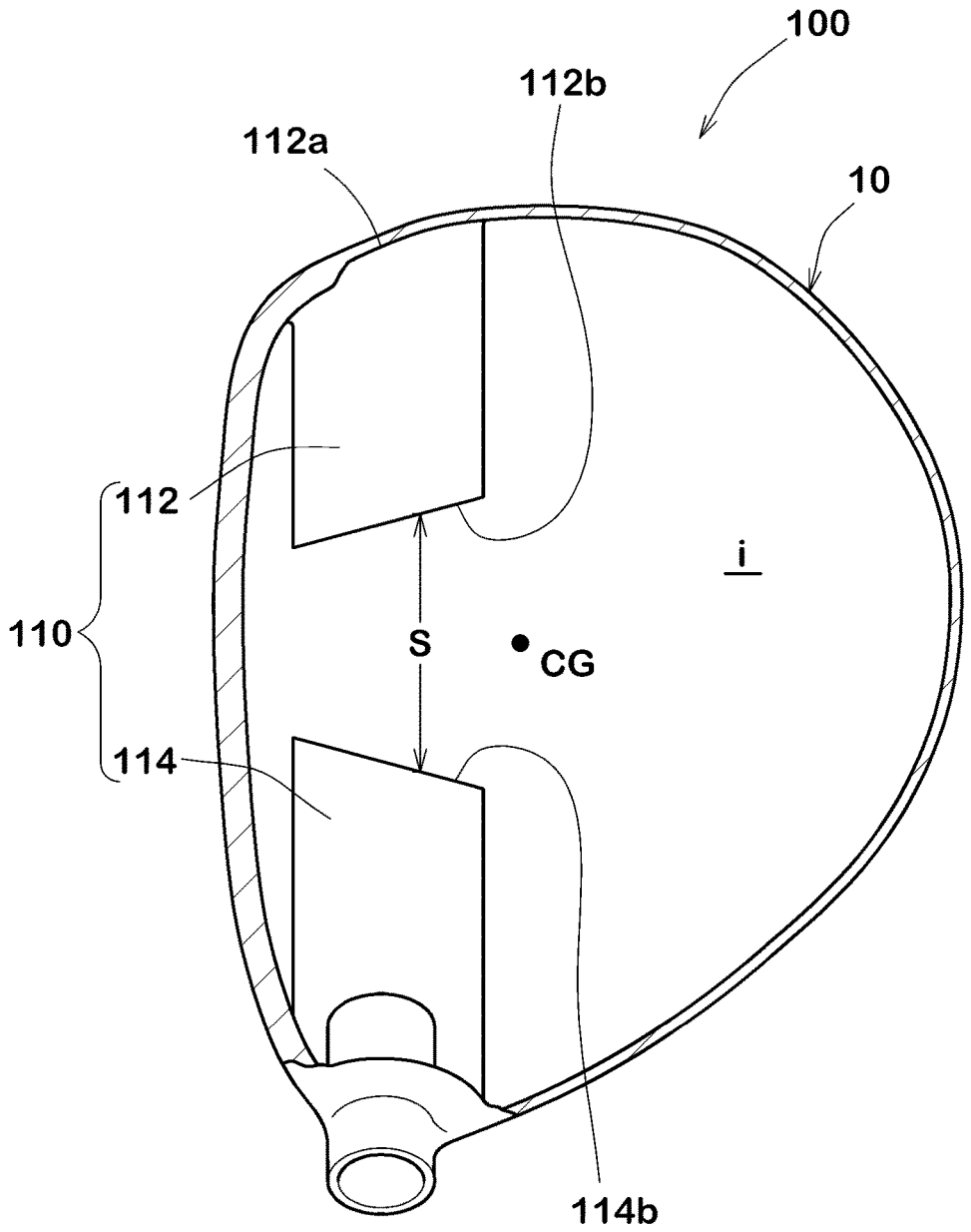
FIG. 19 is a horizontal sectional view of a golf club head as another embodiment of the second aspect of the present invention showing another example of the weight member.

FIG. 19 shows a modification of the weight members 110 shown in FIG. 14, in which the distance s or space between the heel side end 112*b* and the toe side end 114*b* is gradually increased towards the backward of the head in the plan view in order to distribute more weight to the toe side and heel side and front side and thereby to increase the moment of inertia and to decrease the depth of the center of gravity.

In FIG. 19, the heel side end 112*b* and the toe side end 114*b* are substantially straight in the plan view.

Figure 20:
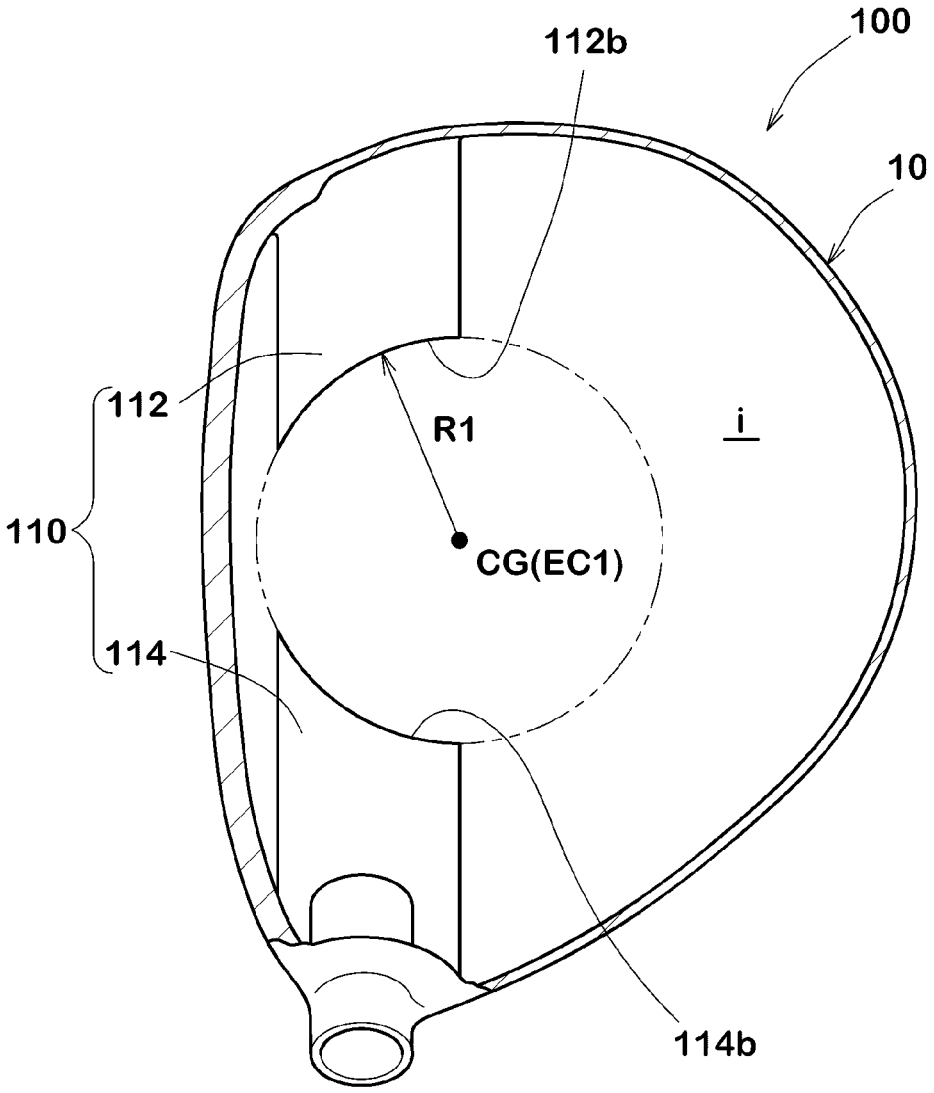
FIG. 20 is a horizontal sectional view of a golf club head as another embodiment of the second aspect of the present invention showing another example of the weight member.

FIG. 20 shows a further modification of the weight members 110 shown in FIG. 19, in which the heel side end 112*b* of the toe side weight member 112 and the toe side end 114*b* of the heel side weight member 114 are curved along a circular arc in the plan view. The center EC1 of the circular arc is preferably set at a position within 3 mm from the center CG of gravity of the head in the plan view. In the example shown in FIG. 20, the center EC1 is positioned at the center CG of gravity of the head.

In the examples shown in FIGS. 14, 19 and 20, the cross-sectional areas of the toe side weight member 112 and the heel side weight member 114 are substantially constant in the toe-heel direction of the head. But, it is also possible to change the cross-sectional areas.

Figure 21:
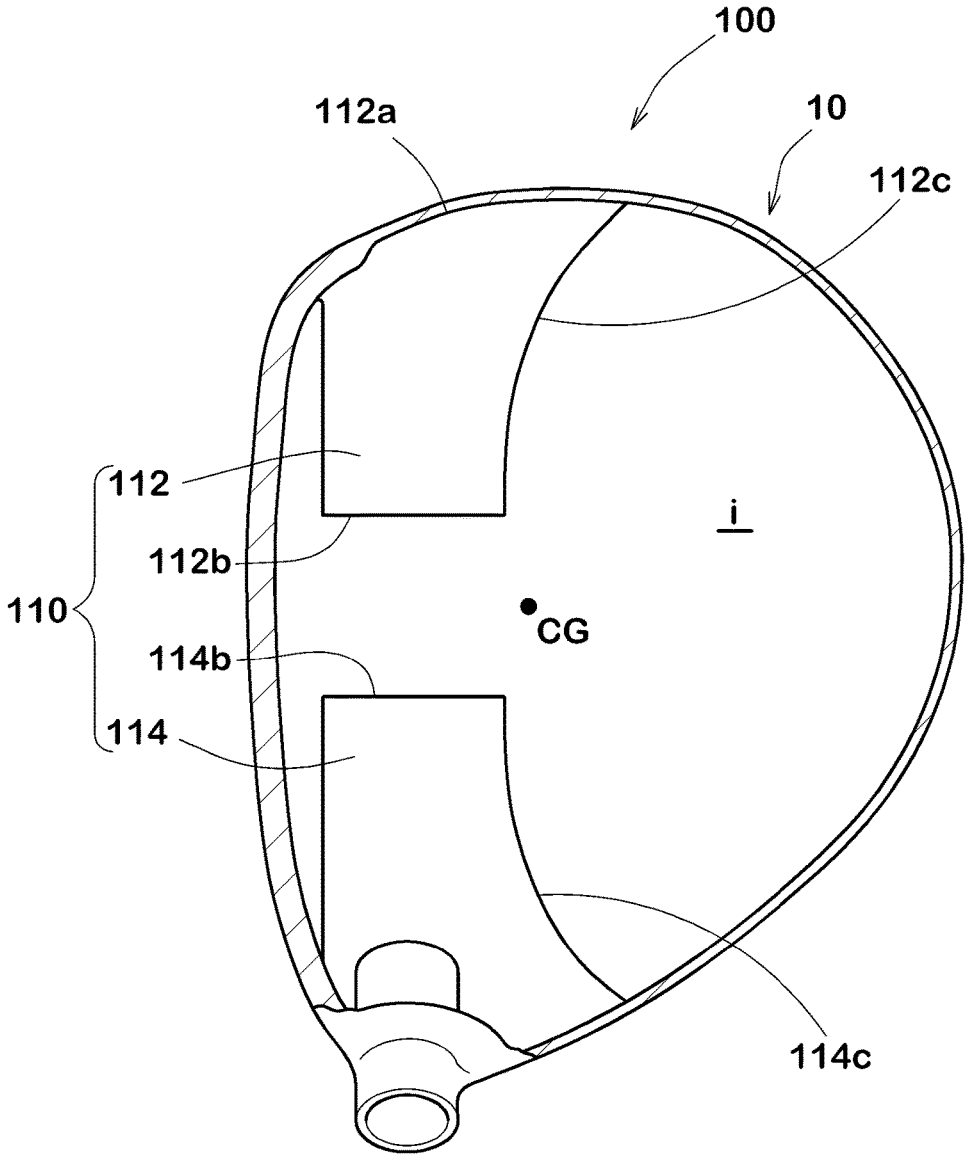
FIG. 21 is a horizontal sectional view of a golf club head as another embodiment of the second aspect of the present invention showing another example of the weight member.

FIG. 21 shows a further modification of the weight members 110, in which the cross-sectional area of the toe side weight member 112 is gradually increased toward the toe, and the cross-sectional areas of the heel side weight member 114 is gradually increased toward the heel.

In this example, the dimension in the front-back direction of the toe side weight member 112 is gradually increased toward the toe, and the dimension in the front-back direction of the heel side weight member 114 is gradually increased toward the heel. Such weight members 110 can efficiently distribute more weight to positions more distant from the center CG of gravity of the head toward the toe and the heel, and can further increase the moment of inertia.

Figure 22:
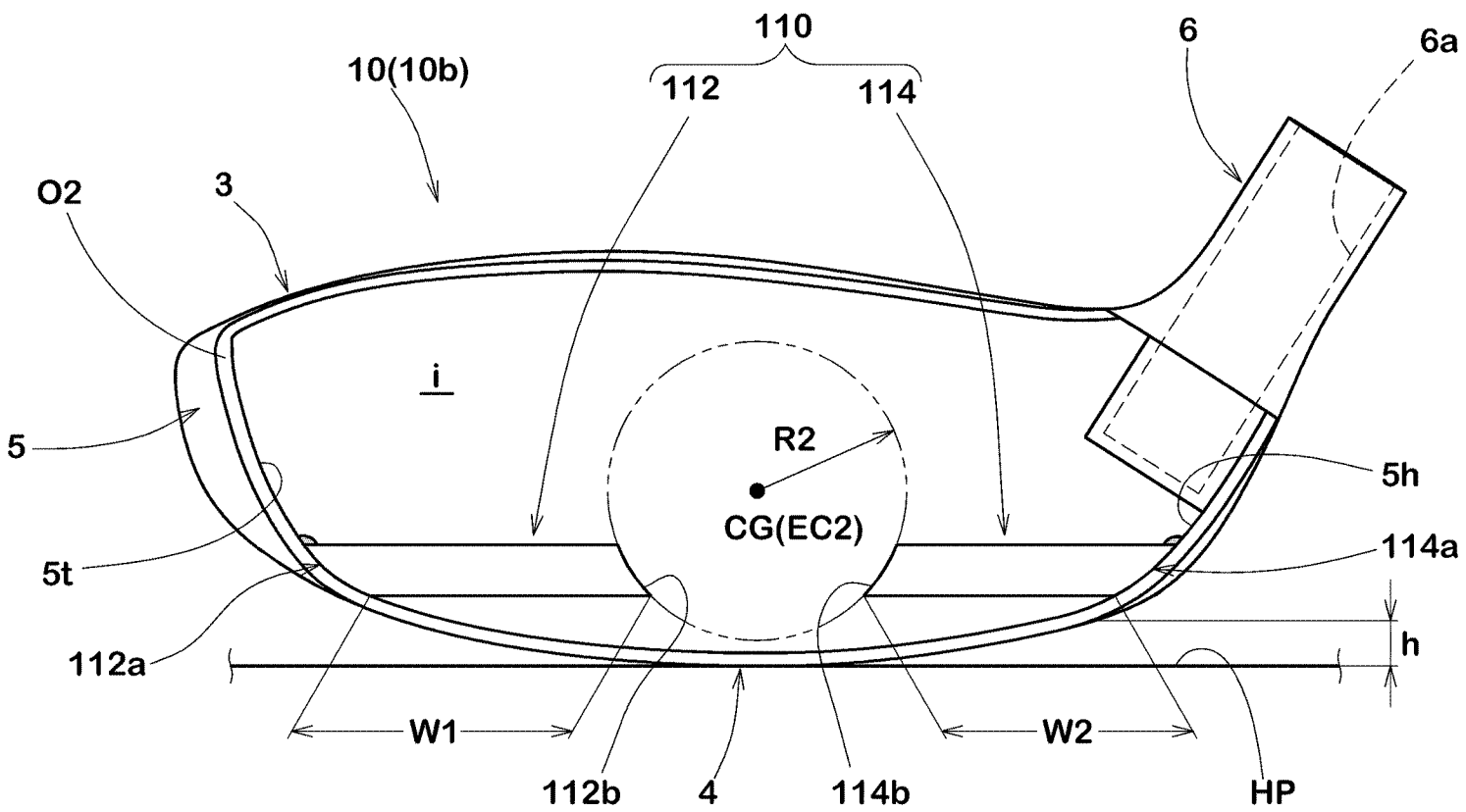
FIG. 22 is a sectional view of a golf club head as another embodiment of the second aspect of the present invention showing another example of the weight member.

FIG. 22 shows a further modification of the weight members 110. In this example, the heel side end 112*b* of the toe side weight member 112 and the toe side end 114*b* of the heel side weight member 114 are curved along a circular arc in the front view. Preferably, the center EC2 of the circular arc is set at a position within 3 mm from the center CG of gravity of the head in the front view in order to distribute more weight to the sole side on the toe side and heel side and thereby to increase the moment of inertia and to decrease the height of the center of gravity.

Figure 23:
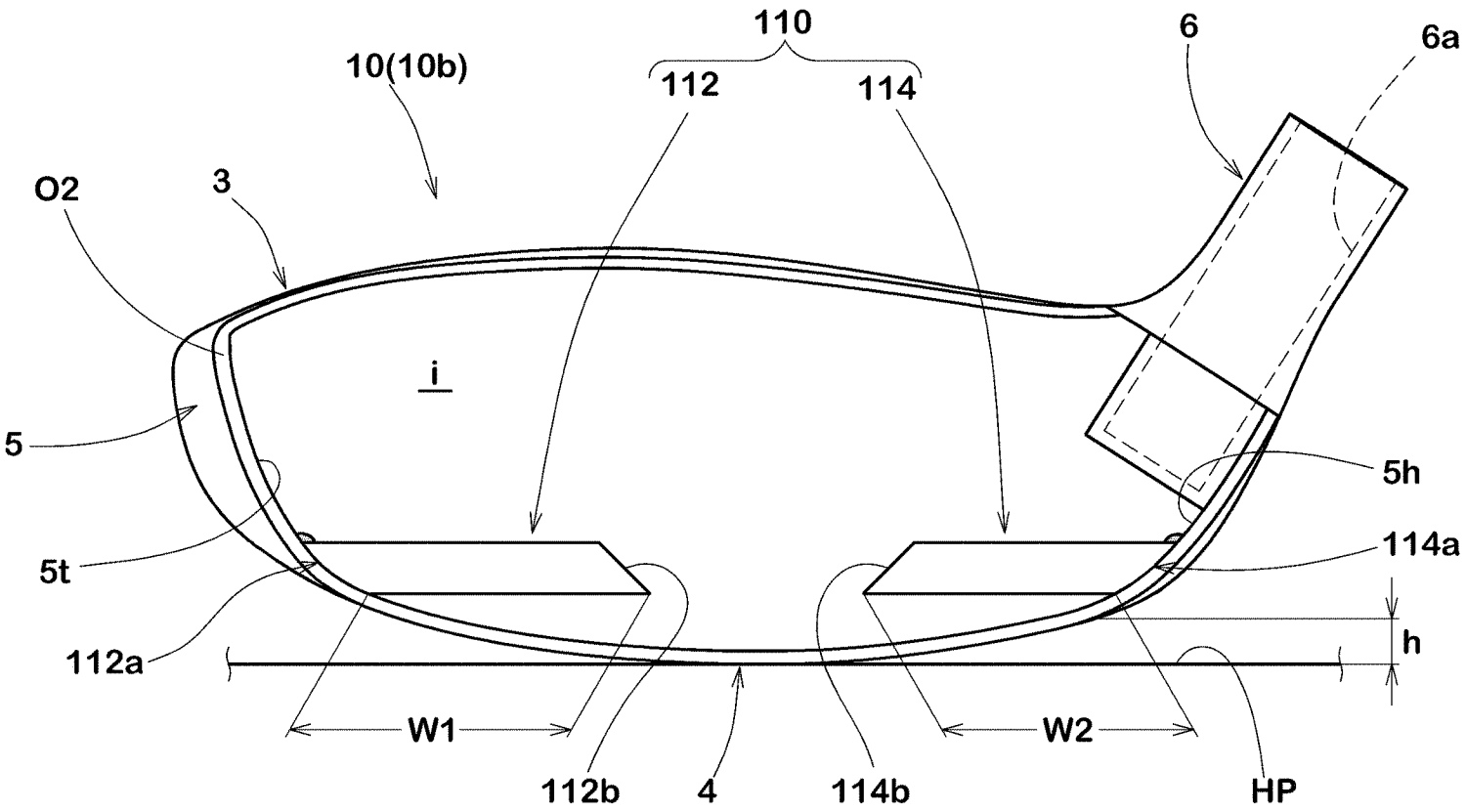
FIG. 23 is a sectional view of a golf club head as another embodiment of the second aspect of the present invention showing another example of the weight member.

FIG. 23 shows a modification of the weight members 110 shown in FIG. 22, in which the heel side end 112*b* and the toe side end 114*b* are formed by downwardly-inclined surfaces instead of the curved surfaces of the FIG. 22 example.

Such configurations (downwardly-inclined surface of FIG. 23 and curved surface of FIG. 22) can be employed in the former embodiments shown in FIGS. 14, 19, 20 and 21.

Further Modifications

The golf club heads 1 and 100 according to the first aspect and second aspect of the present invention may be provided with a front-back position adjuster 50 for changing the position in the front-back direction of the weight member(s) 11, 110, and/or a up-down position adjuster 60 for changing the position in the up-down direction of the weight member(s) 11, 110.

Figure 24:
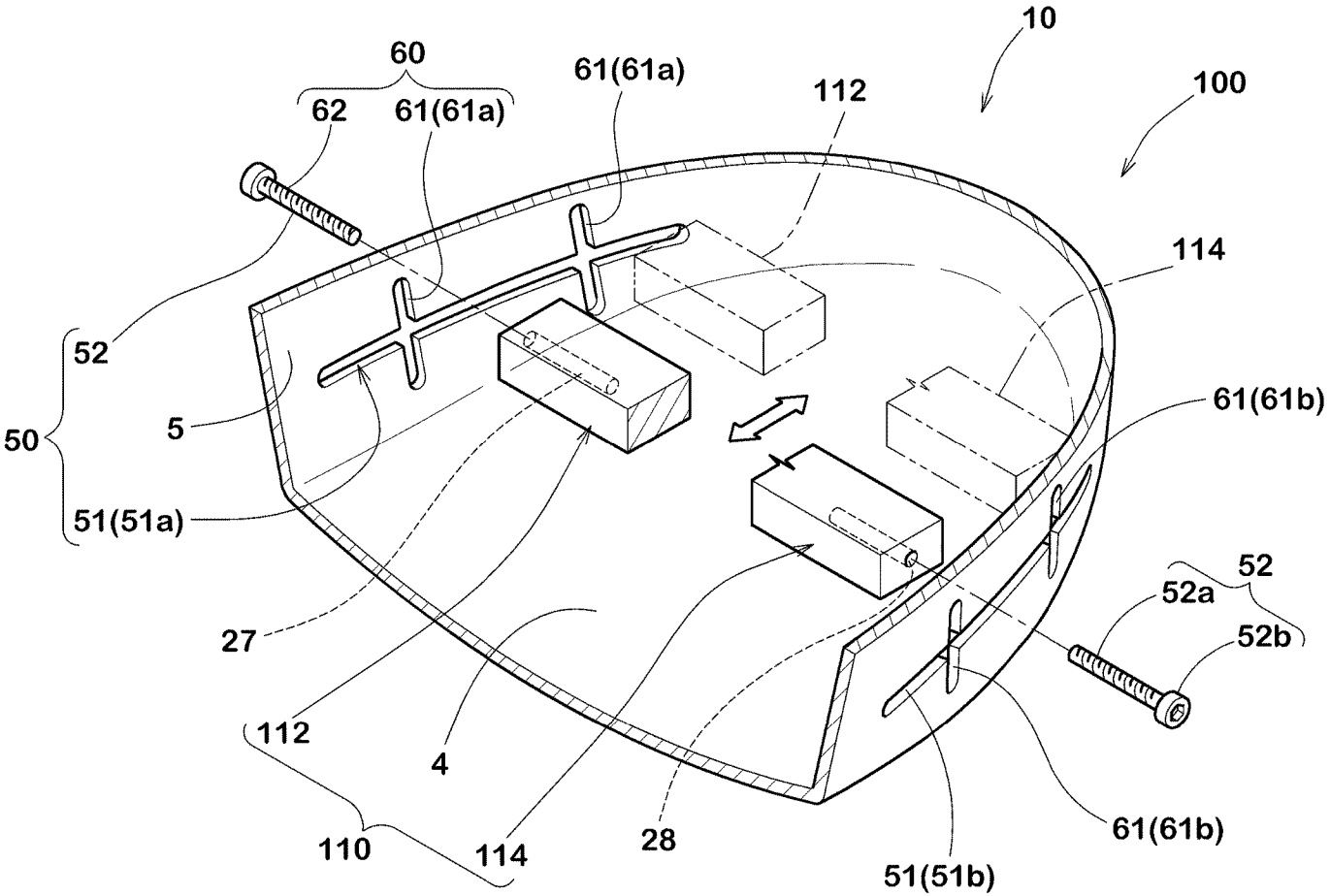
FIG. 24 is an exploded perspective view of a golf club head as another embodiment of the second aspect of the present invention showing another example of the weight member.

FIG. 24 shows an example of the head 100 according to the second aspect of the present invention which is provided with such front-back position adjuster 50 and up-down position adjuster 60.

The front-back position adjuster 50 comprises a first slot 51 extending in the front-back direction of the head provided in the head main body 10, and a screw 52 penetrating through the first slot 51 and fixing the weight members 110 to the head main body 10 at a desired position.

In this example, the first slot 51 is provided in the side portion 5. The first slot 51 includes a toe side first slot 51*a* provided in a toe side of the side portion 5, and a heel side first slot 51*b* provided in a heel side of the side portion 5. Each of the slots 51*a* and 51*b* extends substantially horizontally. The screw 52 consists of a shank 52*a* having a smaller diameter than the width of the first slot 51, and a head 52*b* having a larger diameter than the width of the first slot 51.

The screw 52 is inserted into the threaded hole 27, 28 of the weight member 110 (112, 114) through the first slot 51 (51*a*, 51*b*) from the outside of the head main body 10.

By friction between the head 52*b* of the screw 52 and the head main body 10, the weight member 112, 114 is fixed at an arbitrary position of the head main body 10 without contacting with the inner surface of the sole portion 4 of the head main body 10.

In the case of changing the position of the weight member in the front-back direction of the head, the screw 52 is loosened without being completely detached from the weight member 110, and the screw 52 is moved together with the weight member 110 along the first slot 51 to a preferred position. Then, the screw 52 is tightened to fix the position of the weight member 110. Thus, the position of the center of gravity of the head can be adjusted in the front-back direction.

Preferably, in order that the weight member 112, 114 does not rotate relatively to the head main body 10, the weight member 112, 114 is provided with a protruding portion (not shown) inserted in and engaged with the first slot 51 only slidably therealong After the position of the weight member 110 is adjusted, the first slot 51 may be covered with a removable cover or the like.

The front-back position adjuster 50 is not limited to the above specific example. Any mechanism can be employed as far as the position in the front-back direction of the weight member 110 can be adjusted.

The up-down position adjuster 60 comprises a second slot 61 provided on the head main body 10 to extend in the up-down direction, and an screw 62 penetrating through the second slot 61 and fixing the weight member 112, 114 to the head main body 10 at a desired position. The screw 62 is used commonly to the screw 52 of the front-back position adjuster 50.

In this example, the second slot 61 is provided in the side portion 5. The second slot 61 includes at least one toe side second slot 61*a* provided in a toe side of the side portion 5, and at least one heel side second slot 61*b* provided in a heel side of the side portion 5.

In this example, a plurality of toe side second slots 61*a* and a plurality of heel side second slots 61*b* are provided.

In the case of changing the position of the weight member in the up-down direction of the head, the screw 62 is loosened without being completely detached from the weight member 110, and the screw 62 is moved together with the weight member 110 along the second slot 61 to a preferred position. Then, the screw 62 is tightened to fix the position of the weight member 110. Thus, the position of the center of gravity of the head can be adjusted in the up-down direction.

Preferably, in order that the weight member 112, 114 does not rotate relatively to the head main body 10, the weight member 112, 114 is provided with a protruding portion (not shown) inserted in and engaged with the second slot 61 only slidably therealong Preferably, the second slot 61 extends to intersect the first slot 51 as in this example. Thus, the position of the weight member 110 can be changed in both of the front-back direction and the up-down direction. Accordingly, the center of gravity of the head can be adjusted in both of the front-back direction and the up-down direction.

After the position of the weight member 110 is adjusted, the second slot 61 may be covered with a removable cover or the like.

The up-down position adjuster 60 is not limited to the above specific example. Any mechanism can be employed as far as the position in the up-down direction of the weight member 110 can be adjusted.

In this example, both of the front-back position adjuster 50 and the up-down position adjuster 60 are provided. But, it is of course possible to provide the up-down position adjuster 60 only.

While detailed description has been made of specific embodiments of the present invention, the present invention can be embodied in various forms without being limited to the illustrated embodiments. Especially, the features described in the examples of the first aspect and the features described in the examples of the second aspect can be combined into an embodiment of the present invention as far as there is no inconsistency in the combination.

WORKING EXAMPLES

Based on the specifications listed in Table 1, wood type golf club heads were experimentally manufactured and measured for the depth of the center of gravity and the moment of inertia. Except for the weight members, all of the heads has the same structure.

Comparative Example 1

Figure 25:
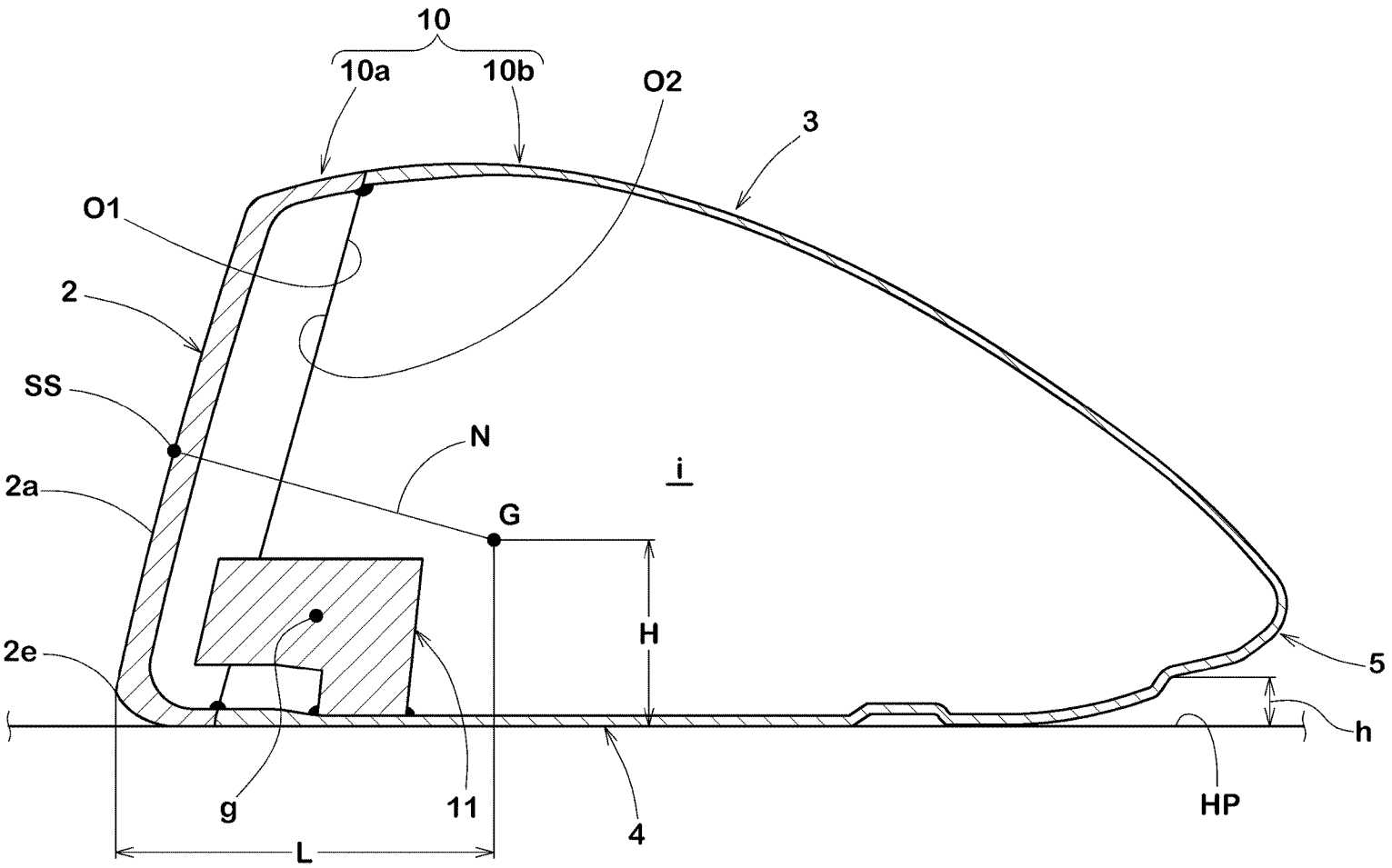
FIG. 25 is a cross-sectional view of a golf club head as a comparative example.

The entire length in the toe-toe-heel direction of a weight member 11 was fixed to the inner surface of the sole portion 4 as shown in FIG. 25.

Comparative Example 2

The structure was the same as that shown in FIG. 5 except that the concave portion 18 was not provided. Therefore, the cross-sectional area of the weight member was constant in the toe-heel direction.

The following are specifications common to all of the heads.

head volume: 180 cc head mass: 214 grams loft angle: 15 degrees face progression: 15.9 mm material of front member of head main body: CUSTOM455 (specific gravity 7.80)

material of rear member of head main body: CUSTOM450 (specific gravity 7.83)

material of weight member: CUSTOM450 (specific gravity 7.83)

mass of weight member: 48 grams

The depth of the center of gravity and the moment of inertia of each head is shown in Table 1.

TABLE 1

| | comparative ex. 1 | comparative ex. 2 | working ex. 1 | working ex. 2 | working ex. 3 | working ex. 4 | working ex. 5 |
|---|---|---|---|---|---|---|---|
| structure (FIG. No.) | 25 | 5(*) | 5 | 7 | 14 | 19 | 20 |
| cross-sectional area Ac of central portion (sq.mm) | 178.5 | 178.5 | 76.7 | 83.8 | 0 | 0 | 0 |
| cross sectional area At of toe side portion (sq.mm) | 157.5 | 157.5 | 161.7 | 178.5 | 218.4 | 243.6 | 323.4 |
| cross-sectional area Ah of heel side portion (sq.mm) | 157.5 | 157.5 | 161.7 | 178.5 | 218.4 | 243.6 | 323.4 |
| depth of center of gravity (mm) | 25.2 | 25.08 | 25.03 | 24.9 | 25.21 | 25.17 | 25.25 |
| inertia moment (g sq.cm) | 2685 | 2673 | 2685 | 2733 | 2812 | 2864 | 2993 |
| percentage depth of center of gravity (%) | 30.81 | 30.66 | 30.60 | 30.44 | 30.82 | 30.77 | 30.87 |

(*)The concave portion was omitted.

From the test results, it was confirmed that as compared with comparative examples, the heads according to the present invention can be increased in the moment of inertia, without increasing the depth of the center of gravity,

DESCRIPTION OF THE REFERENCE NUMERALS

1, 100 golf club head
2 face portion
3 crown portion
4 sole portion
10 head main body
11 weight member
11*a* toe side end portion
11*b* heel side end portion
110 weight member
112 toe-side weight member
112*a* toe side end portion
112*b* heel side end
114 heel side weight member
114*a* heel side end portion
114*b* toe side end

The invention claimed is:

1. A golf club head comprising:

a head main body having a hollow therein, and weight members disposed within the hollow, wherein the weight members include a toe-side weight member and a heel-side weight member, the toe-side weight member has a toe-side end portion fixed to a toe side part of the head main body, and extends from the toe-side end portion toward a heel side of the head main body without contacting with the inner surface of the head main body so as to have a heel-side end terminated within the hollow, the heel-side weight member has a heel-side end portion fixed to a heel side part of the head main body, and extends from the heel-side end portion toward a toe side of the head main body without contacting with the inner surface of the head main body so as to have a toe-side end terminated within the hollow, and the heel-side end and the toe-side end are spaced apart from each other.

2. The golf club head according to claim 1, wherein between the heel-side end and the toe-side end, a space is formed in the toe-heel direction of the head, and the space is increased toward the backward of the head in its plan view.

3. The golf club head according to claim 1, wherein in a plan view, the heel-side end and the toe-side end are curved along a circle arc whose center is located within 3 mm from the center of gravity of the head.

4. The golf club head according to claim 1, wherein between the heel-side end and the toe-side end, a space is formed in the toe-heel direction of the head, and the space is increased toward the backward of the head in its plan view, and in the plan view, the heel-side end and the toe-side end are curved along a circle arc whose center is located within 3 mm from the center of gravity of the head.

5. The head golf club head according to claim 1, wherein a depth of the center of gravity of the head from the club face is not less than a progression of the club face and not more than 27.0 mm, and a moment of inertia of the head around a vertical axis passing through the center of gravity of the head is not less than 2700 g sq. cm.

6. The head golf club head according to claim 5, wherein the moment of inertia of the head around the vertical axis passing through the center of gravity of the head is not less than 2800 g sq. cm.

7. The head golf club head according to claim 1, wherein a percentage depth of the center of gravity is in a range of from {100×face progression (mm) / maximum dimension (mm) of the head in the front-back direction} % to 33.0%, wherein the percentage depth of the center of gravity is 100×the depth of the center of gravity (mm) / the maximum dimension (mm) of the head in the front-back direction.

8. The head golf club head according to claim 1, wherein the head comprises an adjuster for changing the position of the toe-side weight member or the heel-side weight member in at least one of the front-back direction of the head, the up-down direction of the head, and the toe-heel direction of the head.

* * * * *